US010395504B1

(12) United States Patent
Hutz et al.

(10) Patent No.: US 10,395,504 B1
(45) Date of Patent: Aug. 27, 2019

(54) RECORDING ACTIVITY DETECTION

(71) Applicant: Alarm.com Incorporated, Tysons, VA (US)

(72) Inventors: David James Hutz, Herndon, VA (US); Robert Leon Lutes, Lawrence, KS (US); Jean-Paul Martin, Oakton, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 15/938,658

(22) Filed: Mar. 28, 2018

Related U.S. Application Data

(60) Provisional application No. 62/477,662, filed on Mar. 28, 2017.

(51) Int. Cl.

| | |
|---|---|
| ***G08B 21/18*** | (2006.01) |
| ***G08B 29/04*** | (2006.01) |
| ***G08B 29/18*** | (2006.01) |
| ***G08B 13/196*** | (2006.01) |

(52) U.S. Cl.
CPC ..... *G08B 21/18* (2013.01); *G08B 13/196* (2013.01); *G08B 29/04* (2013.01); *G08B 29/18* (2013.01)

(58) Field of Classification Search
CPC ..... G08B 21/18; G08B 25/00; G08B 29/04; G08B 29/18
USPC ..... 340/506
See application file for complete search history.

(56) References Cited

U.S. PATENT DOCUMENTS

| | | | | |
|---|---|---|---|---|
| 4,833,449 | A * | 5/1989 | Gaffigan | G08B 13/00 340/505 |
| 5,774,050 | A * | 6/1998 | Kagi | G08B 25/10 340/531 |
| 6,344,875 | B1 | 2/2002 | Hashimoto et al. | |
| 6,975,204 | B1 | 12/2005 | Silver | |
| 8,175,104 | B2 * | 5/2012 | Connelly | G06F 8/65 370/401 |
| 8,245,315 | B2 | 8/2012 | Cassett et al. | |
| 8,289,130 | B2 | 10/2012 | Nakajima et al. | |
| 8,745,213 | B2 * | 6/2014 | Dare | G06F 8/60 370/352 |
| 8,863,275 | B2 | 10/2014 | Levien et al. | |
| 9,576,157 | B2 | 2/2017 | Fitzgerald et al. | |
| 9,881,152 | B2 | 1/2018 | Fitzgerald et al. | |
| 2006/0218410 | A1 | 9/2006 | Robert et al. | |
| 2012/0093374 | A1 | 4/2012 | Fan et al. | |

FOREIGN PATENT DOCUMENTS

| | | |
|---|---|---|
| JP | 2007312209 | 11/2007 |
| KR | 20020013190 | 2/2002 |

* cited by examiner

*Primary Examiner* — John A Tweel, Jr.
(74) *Attorney, Agent, or Firm* — Fish & Richardson P.C.

(57) ABSTRACT

Systems, methods, and techniques for detecting the recording activity of a sensor are described. A monitoring system includes a sensor that is configured to generate sensor data, as well as a failsafe circuit that is configured to monitor an electronic signal of the sensor and determine that the sensor is recording. The system can further include a control unit that receives indication from the failsafe circuit that the sensor is recording and, based on determining that the control unit did not request the sensor to record or that the control unit is not aware that the sensor is recording, the system outputs a signal, e.g. to an indicator light, indicating that the sensor is recording.

19 Claims, 9 Drawing Sheets

RECORDING ACTIVITY DETECTION

CROSS-REFERENCE TO RELATED APPLICATION

This application claims the benefit of U.S. Provisional Application No. 62/477,662, filed Mar. 28, 2017, and titled "Recording Activity Detection," which is incorporated by reference.

TECHNICAL FIELD

This application relates generally to techniques for monitoring data recording in a monitoring system.

BACKGROUND

Property owners often equip their properties with monitoring systems that include sensors for recording data. Adverse parties may try to record sensor data without the property owner's knowledge.

SUMMARY

To prevent surreptitious recording without a person's knowledge, a system includes a failsafe circuit that can monitor activity, such as power and audio/video data transfer, corresponding to a recording device or sensor. The system can be configured to identify when the device or sensors are active and/or in use and provide an indication that the activity is detected. The indication can be a visual indication, such as turning an LED light on, an audial indication, such as emitting a sound over a speaker, a notification to a user's mobile device, a message to a connected computing system, or another indication.

In some implementations, a monitoring system is configured to monitor a property. The monitoring system can include a sensor that is configured to generate sensor data and a failsafe circuit. The failsafe circuit can (i) monitor an electronic signal of the sensor, (ii) based on monitoring the electronic signal of the sensor, determine that the sensor is generating the sensor data, and (iii) based on determining that the sensor is generating the sensor data, provide, for output, data indicating that the sensor is generating the sensor data.

In some implementations, the monitoring system includes a sensor, a failsafe circuit, and a monitor control unit. The sensor can be configured to generate sensor data. The failsafe circuit can be configured to (i) monitor an electronic signal of the sensor, (ii) based on monitoring the electronic signal of the sensor, determine that the sensor is generating the sensor data, and (iii) generate data indicating that the sensor is generating the sensor data. The monitor control unit can be configured to (i) receive the data indicating that the sensor is generating the sensor data, (ii) determine that the monitor control unit did not generate a request for the sensor to generate the sensor data or that the monitor control unit is not aware that the sensor is generating sensor data; and (iii) based on receiving the data indicating that the sensor is generating the sensor data and based on determining that the monitor control unit did not generate a request for the sensor to generate the sensor data or that the monitor control unit is not aware that the sensor is generating sensor data, provide, for output, data indicating that the sensor is generating the sensor data.

In some implementations, the failsafe circuit is included in the sensor. In some implementations, the failsafe circuit is separate from the sensor.

In some implementations, the failsafe circuit monitors an electronic signal of the sensor by monitoring a voltage of an electronic signal of the sensor. Based on the voltage of the electronic signal of the sensor, the failsafe circuit can generate a voltage value, compare the voltage value to a voltage threshold, determine that the voltage value satisfies the voltage threshold, and determine that the sensor is generating the sensor data based on determining that the voltage value satisfies the voltage threshold. For example, in some implementations, the failsafe circuit is configured to generate the voltage value by generating a root-mean-square voltage of the electronic signal of the sensor. In some implementations, the failsafe circuit can also be configured to generate the voltage threshold by monitoring additional data output by the sensor while the failsafe circuit receives an indication that the sensor is generating sensor data and, generate the voltage threshold based on a voltage of the additional data.

In some implementations, the monitor control unit provides, for output, data indicating that the sensor is generating the sensor data. For example, the monitor control unit can provide, for output to the sensor, an instruction to activate a notification light of the sensor. In another example, the monitor control unit can provide, for output to a resident of the property, a notification that the sensor is generating the sensor data.

In some implementations, based on monitoring an electronic signal of the sensor, the failsafe circuit is configured to identify a token packet that indicates the sensor and the monitor control unit are communicating. The failsafe circuit can determine that the sensor is generating the sensor data by determining that the electronic signal of the sensor includes the token packet and additional data. For example, the sensor can be a microphone and the failsafe circuit can determine that the sensor is generating the sensor data by determining that the electronic signal of the sensor includes the token packet and audio data.

In some implementations, the failsafe circuit is configured to determine a frequency of token packets transmitted between the sensor and the monitor control unit. The failsafe circuit can further monitor the electronic signal of the sensor at a frequency that is greater than the frequency of the token packets being transmitted between the sensor and the monitor control unit. Based on monitoring the electronic signal of the sensor at a frequency that is greater than the frequency of the token packets being transmitted between the sensor and the monitor control unit, the failsafe circuit can determine that the electronic signal of the sensor includes the token packets and additional data. By determining that the electronic signal of the sensor includes the token packets and additional data, the failsafe circuit can determine that the sensor is generating the sensor data. For example, the sensor can be a camera and the failsafe circuit can determine that the electronic signal of the sensor includes the token packets and additional data by determining that the monitored electronic signal includes the token packets and video data.

In some implementations, the electronic signal of the sensor is an output signal of the sensor that includes a data packet, and the failsafe circuit determines that the sensor is generating the sensor data based on determining that the output signal of the sensor includes a data packet.

In some implementations, the electronic signal of the sensor is a signal indicating whether a power supply of the sensor is enabled. The failsafe circuit can determine that the sensor is generating the sensor data based on determining that the electronic signal indicates that the power supply of the sensor is enabled.

In some implementations, the electronic signal of the sensor is a signal indicating whether a component of the sensor is receiving power. For example, the component of the sensor can be an image sensor, a power supply, or another sensor component. The failsafe circuit can determine that the sensor is generating the sensor data based on determining that the electronic signal of the sensor indicates that the component of the sensor is receiving power. Similarly, in some examples, the electronic signal of the sensor is a signal indicating that a component of the sensor is enabled. The failsafe circuit can determine that the sensor is generating the sensor data based on monitoring the electronic signal of the sensor indicating that the component of the sensor is enabled. When the component is receiving power or enabled, the sensor may be generating data.

In some implementations, the electronic signal of the sensor is a signal indicating whether the sensor is enabled and generating data. The failsafe circuit can determine that the sensor is generating the sensor data based on determining that the electronic signal of the sensor indicates that the sensor is enabled and generating data.

In some implementations, the sensor is further configured to transmit the sensor data. The failsafe circuit can then also be configured to receive, from the monitor control unit, data indicating that the sensor is generating the sensor data and/or data indicating that the monitoring system is not aware that the sensor is generating sensor data. Based on receiving the data, the failsafe circuit can prevent the sensor from transmitting the sensor data.

Implementations of the systems and techniques described can provide particular advantages. The failsafe circuit can be integrated into the system to alert a user to when camera activity is detected and preventing an adverse party blocking indication of the activity. In this instance, the system may be used to signal when a camera is in use, by monitoring the activity of the camera at all times. In some implementations, the failsafe circuit monitors both the true indication signal of the camera and the indicator control. In this instance, the failsafe circuit may be configured to activate one or more indicators that would indicate an attempt of a third party to bypass the indicator control. In some examples, if the system determines that the camera is operating but the camera activity indicator is in the off-state, the system may disable or inhibit the camera from operating to prevent a third party from surreptitiously recording camera data.

The details of one or more implementations are set forth in the accompanying drawings and the description, below. Other potential features and advantages of the disclosure will be apparent from the description and drawings, and from the claims.

BRIEF DESCRIPTION OF THE DRAWINGS

Unless otherwise indicated, like reference numbers and designations in the various drawings indicate like elements.

DETAILED DESCRIPTION

Figure 1A:
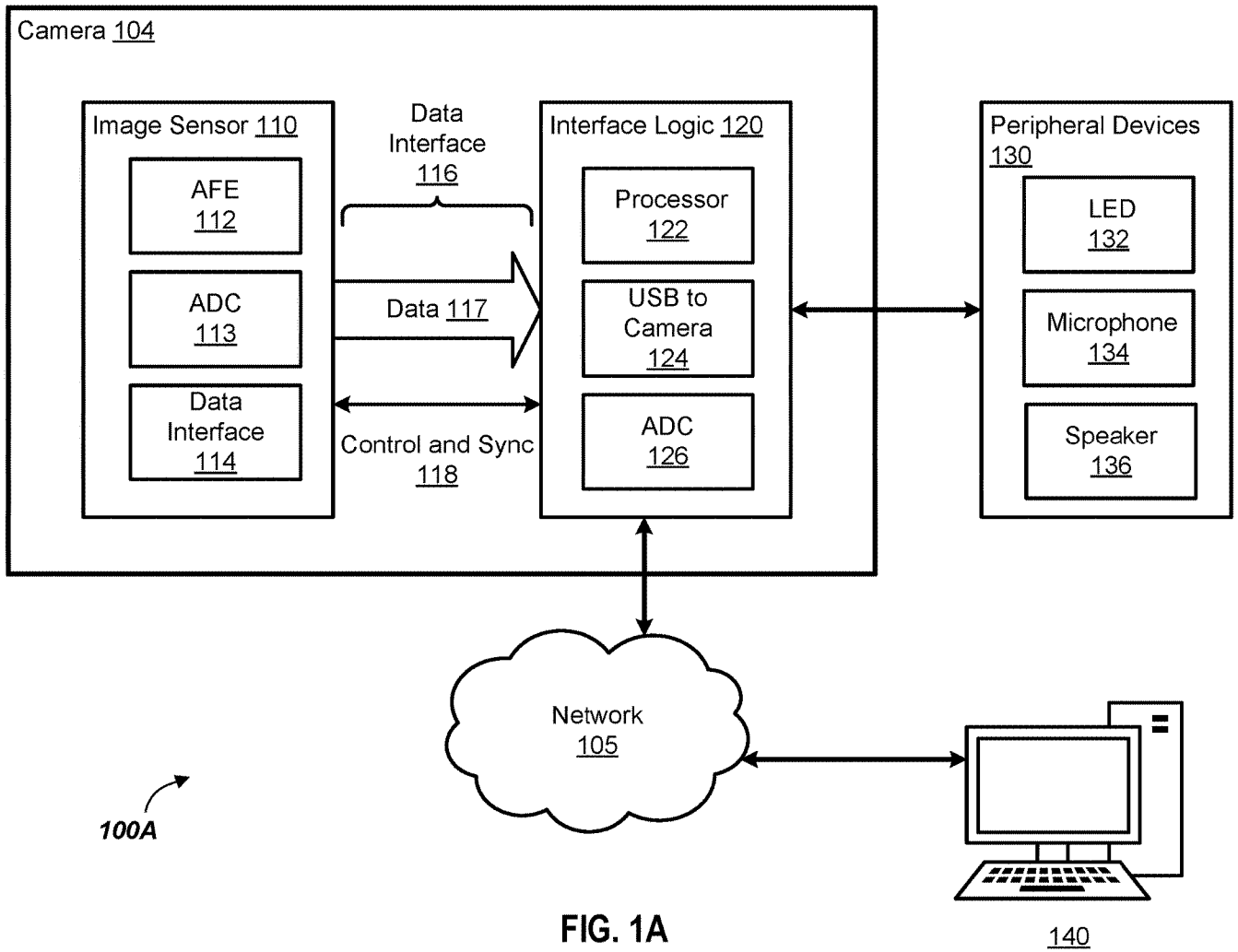
FIG. 1A is a diagram of an example system for capturing data.

Residents and property owners often equip their properties with property monitoring systems to enhance the safety and security of the property. In some implementations, the property monitoring system includes a recording device or sensor, such as a camera or a microphone, to monitor activity at the property. The recording device may use an activity indicator to inform a user that an activity is being recorded. The activity indicator may be controlled in a manner that allows the indicator to be disabled by a third party, and the user may be recorded without being informed. For example, the activity indicator may be software or firmware controlled and not an actual indication of device operation or activity. An activity indicator that is not able to be disabled through software or firmware would make the user feel secure and also give an indication of a system that has had its security compromised. The activity indicator is usually controlled by a general purpose I/O line that is controlled by interface logic, such as an interface logic circuit. The state (e.g., on or off) of the indicator is controlled by firmware that controls the operation of the interface logic, or as a function of the driver software on the host system. By substituting drivers or replacing interface logic firmware, it is possible to disable the activity indicator while the device is activated for recording or streaming. As such, the activity indicator of the device may be controlled remotely by an adverse party via software. For example, when a device is in privacy mode, the device may be capturing data with an activity indicator that is controlled by software to be in the off state. In this instance, the user may falsely believe the device is in privacy mode, due to the activity indicator being manipulated by the adverse party.

This document discloses methods, systems, and devices that are used to identify activity using a failsafe circuit. As discussed in more detail below, a system for identifying activity using a failsafe circuit may monitor activity such as power and audio/video data transfer corresponding to a recording device or sensor. The system may be configured to identify when the device or sensors are active and/or in use. When activity of the device or sensors is identified, the system may provide an indication that the activity is detected. The indication may be a visual indication, such as turning an LED light on, an audial indication, such as emitting a sound over a speaker, and the like. The system may be configured to monitor the device so that the indication is provided whenever the camera is active or in use. As such, the failsafe circuit may be integrated into the system so that an adverse party is unable to stop the system from providing the indication. In this instance, the system may be used to signal when a device is in use, by monitoring the activity of the device at all times.

The failsafe circuit can be implemented into the system in a variety of different ways. The failsafe circuit can replace existing device activity indicator control. Alternatively, or additionally, the failsafe circuit can be used to drive another indicator to be used in conjunction with the existing activity indicator control. In this instance, the failsafe circuit may provide an indication of device use that is bypassing the activity indicator control. The failsafe circuit may be integrated with a device so the failsafe circuit monitors both the true indication signal of the device and the activity indicator control. In this instance, the failsafe circuit may be configured to activate one or more indicators that would indicate an attempt of a third party to bypass the activity indicator control. Therefore, the true indication signal may be used to supplement the existing activity indicator control of the device. For example, a device may be in privacy mode with an activity indicator control including an LED that is off. However, an adverse party may be controlling the activity indicator control via software. The failsafe circuit may be configured to provide a supplementary indication that the device is active, despite the device being in privacy mode where the LED of the activity indicator control in the off state.

In some implementations, if the system determines the device is operating but the device activity indicator is in the off-state (e.g., a third party is attempting to bypass the activity indicator control), the system may disable or inhibit the device from operating to prevent a third party from surreptitiously recording device data. In certain aspects, the failsafe circuit may be configured to always shut off power to the device when the device is in privacy mode.

The detection of device activity and other use conditions can be communicated to the computing system. The detected activity can be provided to the computing system for output by the failsafe circuit. As such, the computing system may generate a notification that notifies a user of a working or bypassed activity indicator control. The system may further include a physical switch that permits the true indication function of the failsafe circuit to be disabled. Though described below primarily in the context of a camera, the disclosed systems, methods, techniques, and devices should be understood to apply generally to other types of recording devices and sensors, including microphones, and other devices for capturing video and/or audio data.

FIG. 1A is a diagram of an example system 100A for capturing data. The example system 100A includes a network 105, such as a local area network (LAN), a wide area network (WAN), the Internet, or any combination thereof. The network 105 connects a camera 104, peripheral devices 130, and a computing device 140. The example system 100A may include multiple cameras 104, peripheral devices 130, and computing devices 140. In some implementations, the example system 100A is part of a property monitoring system, for example, the property monitoring system of FIG. 9.

A camera 104 is an electronic device that is capable of capturing and transmitting image data, such as a webcam, a video camera, a digital camera, and the like. The image data can include individual images, such as photographs, or sequences of images, such as videos or movies. The camera 104 can include one or more cameras connected to the peripheral devices 130 and the computing device 140 over the network 105. The camera 104 can be configured to record and transmit image data over the network 105.

The camera 104 can include an image sensor 110 and interface logic 120. The image sensor 110 can include one or more image sensors such as a CMOS image sensor. In some aspects, the image sensor 110 includes an analog front end (AFE) 112, analog to digital converter (ADC) 113, and a data interface 114. For example, the image sensor 110 may include a CMOS based sensor including an AFE, ADC, and interface logic integrated into a semiconductor. The image sensor 110 may include one or more color sensors. In this instance, the image sensor 110 may include multiple channels for each of the color sensors, such as a first red channel, a second blue channel, and a third green channel. The interface logic between the multiple channels may be common. The color sensors may aid the camera 104 in capturing one or more color images.

The image sensor 110 is connected to the interface logic 120 over a data interface 116, such as a low level data interface. For example, the low level data interface may be an application programming interface (API) that enables manipulation of hardware and/or software functionality of the camera 104. The data interface 116 can be a serial or parallel interface that transfers data and other signals from the image sensor 110 to the interface logic 120. Audio or image data may be transferred over the data lines 117 and control and sync signals, such as enable power supply, may be transferred over the control and/or sync lines 118. Activity on the outputs of the data lines 117 may indicate that camera data is being transferred to the interface logic 120. Activity on the outputs of the control and/or sync lines 118 may indicate that the image sensor 110 is powered on or off.

The data lines 117 and the control/sync lines 118 may be monitored to provide an indication of activity between the image sensor 110 and the interface logic 120. For example, the image sensor 110 can be controlled to capture still images via the control and/or sync lines 118. The image sensor 110 may capture the images in analog format, convert the images from analog to digital format, and transmit the digital image data to the interface logic 120 over the data lines 117. In this instance, the data lines 117 and control and/or sync 118 lines may be monitored independently to yield indications of activity of the camera 104 (e.g., drivers of the camera 104 do not need to be monitored to detect activity of the camera 104).

The interface logic 120 is configured to receive data and control and/or sync signals from the image sensor 110. The interface logic 120 can be configured to convert the received data from the data lines 117 into a particular file and/or format. The interface logic 120 can further be configured to transmit the converted file and/or format to the computing device 140 over the network 120.

In some aspects the camera 104 is connected to one or more peripheral devices 130. The peripheral devices 130 can include an LED 132, a microphone 134, a speaker 136, and the like. The peripheral devices 130 can be separate from the camera 104 or integrated with the camera 104 into a single unit. The LED 132 may be used to indicate a power status of the camera 104. For example, the camera 104 may be configured to provide an indication of power via the LED 132 when the camera 104 is in use. The microphone 134 may be used by the camera 104 to receive audio data. In this instance, the audio data may be transmitted to the interface logic 120 from the microphone 134, to be processed into digital format. The speaker 136 may be used by the camera 104 to provide an audial indication of camera activity. For example, the camera 104 can be configured to emit a sound via the speaker 136 when the camera 104 is actively capturing images or videos.

The computing device 140 can include one or more computing devices in connection with the camera 104 over the network 105. The computing device 140 can include a personal computer, a mobile communication device, or other device that can send and receive data over a network. The computing device 140 can be configured to receive audio or video data from the camera 104 and/or peripheral devices 130 to provide the audio or video data for output. In some implementations, the computing device 140 is a control unit that is part of a property monitoring system.

In some implementations, the camera 104, the peripheral devices 130, and the computing device 140 are integrated into a single device. For example, the camera 104, the peripheral devices 130, and the computing device 140 may be included in a single device such as a laptop or a mobile phone. In this instance, activity of the camera 104 within the laptop may be monitored via hardware of the laptop.

Figure 1B:
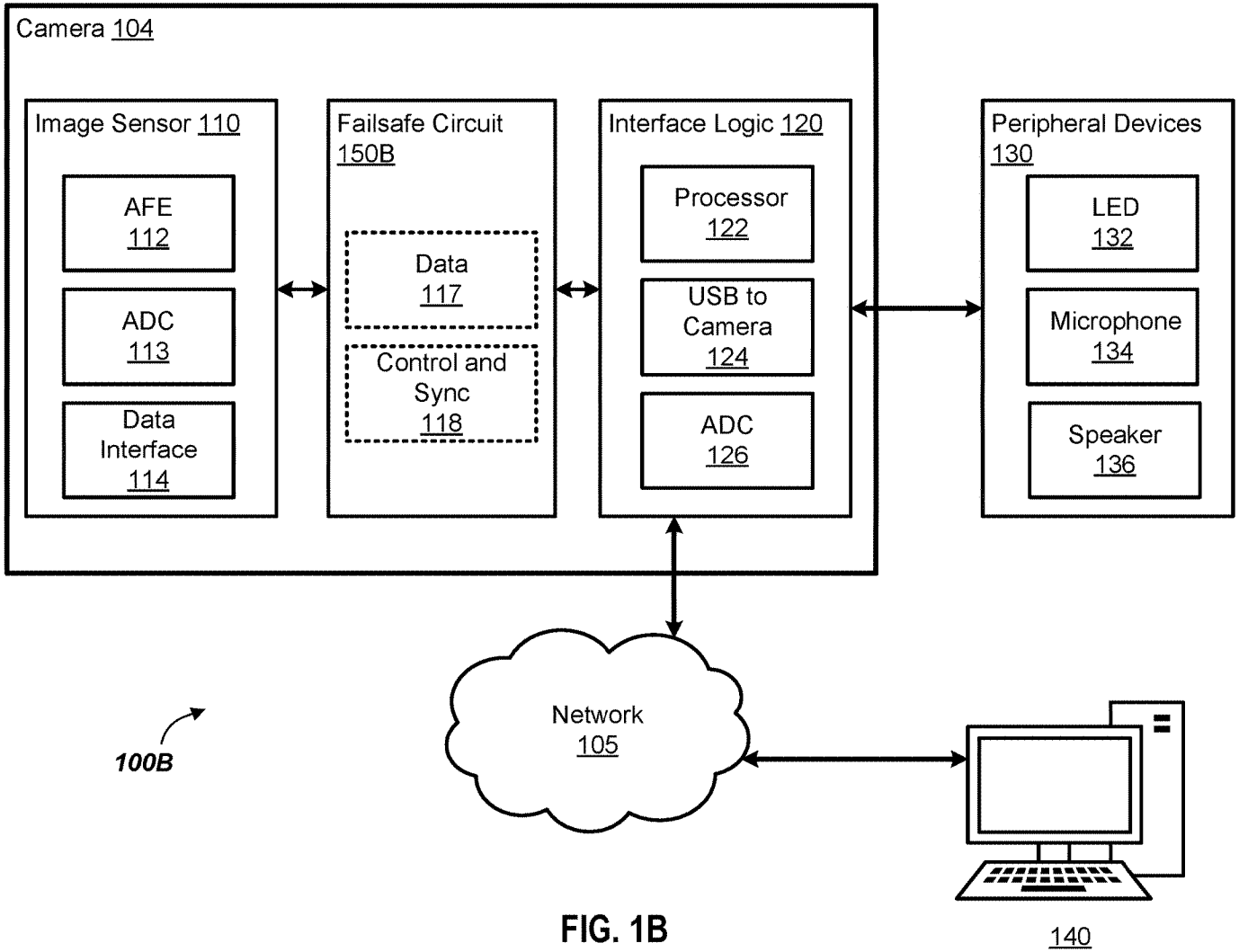
FIGS. 1B-1C are diagrams of an example system for identifying activity using a failsafe circuit.

FIG. 1B is a diagram of an example system 100B for identifying activity using a failsafe circuit. System 100B includes a network 105, such as a local area network (LAN), a wide area network (WAN), the Internet, or any combination thereof. The network 105 connects a camera 104, peripheral devices 130, and a computing device 140. The example system 100A may include many different cameras 104, peripheral devices 130, and computing devices 140.

The system 1006 further includes a failsafe circuit 1506 located in the camera 104, between the image sensor 110 and the interface logic 120. The failsafe circuit 150B may be hardwired into the camera 104. The failsafe circuit 150B can be configured to monitor the data lines 117 and the control and/or sync lines 118. In this instance, all data and signals transmitted between the image sensor 110 and the interface logic 120 passes through the failsafe circuit 150B.

The failsafe circuit 1506 may be a semi-retrofit that is integrated into circuitry of the camera 104. As such, the failsafe circuit 1506 may be interconnected between or connected to the image sensor 110 and the interface logic 120 to detect when the camera 104 is active. For example, the failsafe circuit 1506 may be configured to detect when data is transmitted over the data lines 117 from the image sensor 110 to the logic interface 120. In this instance, the failsafe circuit 1506 may determine that data transfer is present within the camera 104, indicating activity within the camera 104. In another example, the failsafe circuit 1506 may be configured to detect when control and/or sync signals are transmitted between the image sensor 110 and the logic interface 120. In this instance, the failsafe circuit 1506 may be configured to detect when power is supplied to the camera 104 or the image sensor 110 is enabled, indicating that the camera 104 is active. The failsafe circuit 1506 can also be configured to monitor both the data lines 116 and the control and/or sync lines 117 of the camera 104.

The failsafe circuit 1506 can be configured to determine when an activity is present, and provide an indication in response to the detected activity. In some aspects, the indication includes an actuation of the peripheral devices 130, such as turning the LED 132 on. As such, the failsafe circuit 1506 can be configured to identify the presence of activity in the camera 104, and in response, provide a signal to turn the LED 132 on for a predetermined amount of time.

Figure 1C:
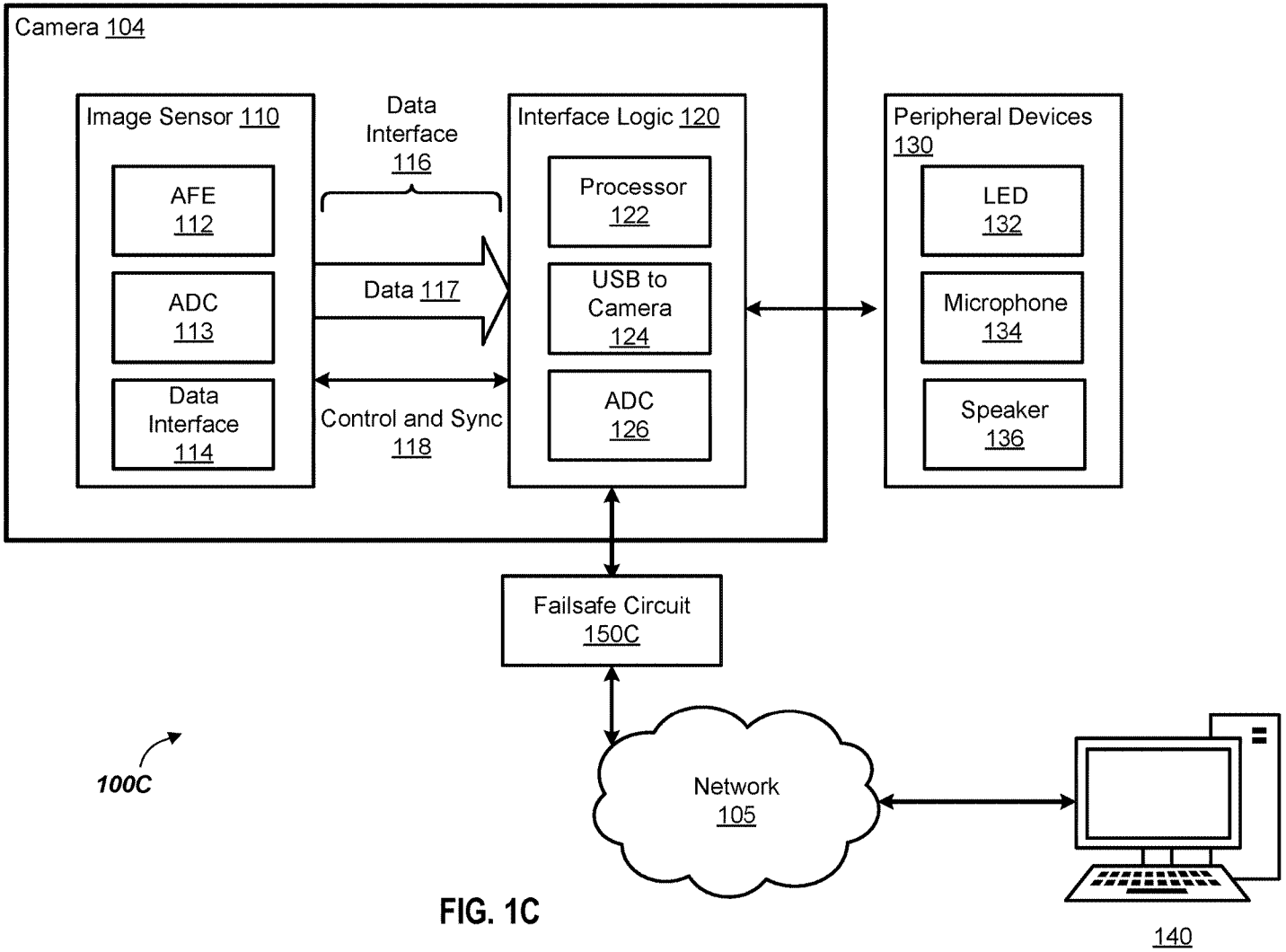

FIG. 1C is a diagram of an example system 100C for identifying activity using a failsafe circuit. System 100C includes a network 105, such as a local area network (LAN), a wide area network (WAN), the Internet, or any combination thereof. The network 105 connects a camera 104, peripheral devices 130, and a computing device 140. The example system 100A may include many different cameras 104, peripheral devices 130, and computing devices 140.

The system 100C further includes a failsafe circuit 150C between the camera 104 and the computing device 140. In this instance, output of the interface logic 120 may be monitored by the failsafe circuit 150C to detect activity of the camera 104. The failsafe circuit 150C may be a retrofit in which the failsafe circuit 150C is implemented as an inline detector between the camera 104 and the computing device 140. For example, the failsafe circuit 150C may be integrated into a device with cabling including a plug and a receptacle. The plug of the device may be inserted into the computing system 140 and the camera 104 may be inserted into the receptacle of the device. As such, all transmission of data and/or signals between the camera 104 and the computing device 140 passes through the failsafe circuit 150C.

The failsafe circuit 150B of FIG. 1B and the failsafe circuit 150C of FIG. 1C can be used individually, or in combination. Each of the failsafe circuits 150B and 150C can be incorporated in any system that uses a camera and/or microphone such as a cell phone, premises surveillance, security, or home or laptop computer systems. The failsafe circuits 150B and 150C can be integrated into systems, added as an upgrade to existing systems, and/or possibly integrated into a device that is inserted in the communication path between a camera and a computing system. For example, the failsafe circuit 150C can be integrated into devices such as a USB dongle, Ethernet pass through (or switch), in an RF data path, and the like. The failsafe circuits 150B and 150C may be configured to provide an indication of identified activity within cameras and/or microphones. The indicator can include providing a visual indication through an indicator in communication with the camera 104, a pop-up at the computing device 140, an email to a user, or any other type of notification.

Figure 2:
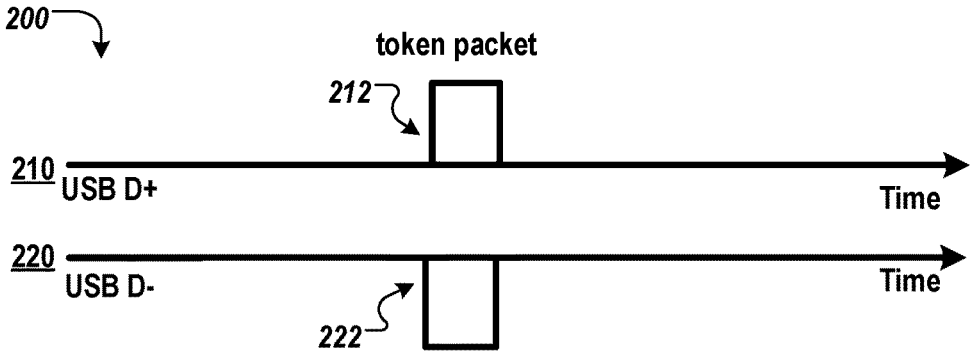
FIG. 2 is a diagram of example signals for a camera that is not recording.

FIG. 2 is a diagram of example signals 200 for a camera that is not recording. The signals 200 refer to a failsafe circuit monitoring transmission of data between a camera and a computing device. The signals 200 include two data lines 210 and 220 that are monitored for data passing between the camera and the computing device through the failsafe circuit.

The data line 210 represents a USB D+ signal of the camera and the data line 220 represents a USB D− signal of the camera. Referring to FIG. 2, the data lines 210 and 220 each include a single, respective data packet 212 and 222. The data packets 212 and 222 may each include states of ones, zeroes, or any combination thereof. For example, a packet may correspond to a collection of header and/or information data based on a certain protocol. The data packets 212 and 222 indicate an active connection between the camera and the computing device. In this instance, significant data is not being transmitted between the camera and the computing device. Instead, the data packets 212 and 222 are identified as token packets or handshake packets that indicate the camera is connected but not active (e.g., not recording) over the monitored period of time. The normal state of data lines 210 and 220 may be a continuous series of token and handshake packets when audio, video, or file data is not being transmitted.

Figure 3:
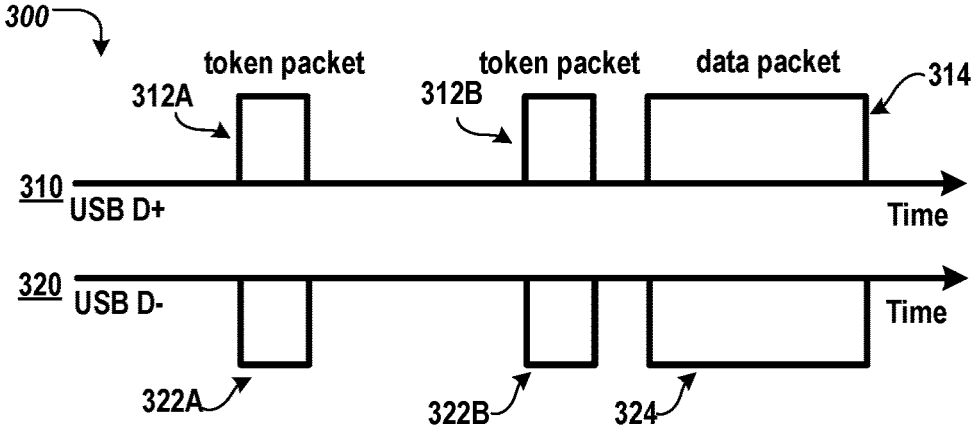
FIG. 3 is a diagram of example signals for a camera that is recording.

FIG. 3 is a diagram of example signals 300 for a camera that is recording. The signals 300 refer to a failsafe circuit monitoring transmission of data between a camera and a computing device. The signals 300 include two data lines 310 and 320 that are monitored for data passing between the camera and the computing device through the failsafe circuit.

The data line 310 represents a USB D+ signal of the camera and the data line 320 represents a USB D− signal of the camera. Referring to FIG. 3, the data lines 310 and 320 each include multiple data packets. The multiple data packets may each include states of ones, zeroes, or any combination thereof. For example, the data line 310 includes a first token packet 312A, a second token packet 312B, and a third data packet 314. The first token packet 312A and the second token packet 312B are similar in length of time, however, the third data packet 314 occurs for a greater period of time. In this instance, the token packets 312A and 312B are identified by the failsafe circuit as communication packets. The communication packets without data packets indicate that the camera is not active over the respective periods of time in which the communication packets are present. The data packet 314, however, represents transmission of data between the camera and the computing device through the failsafe circuit. As such, the failsafe circuit may identify that the camera is active during the period of time in which the data packet 314 is present. In response to identifying the activity of the camera, the failsafe circuit may be configured to provide an indication of the activity.

Similar to data line 310, the data line 320 includes two communication packets 322A and 322B followed by a third, longer data packet 324. The data packets 314 and 324 may each refer to the transmission of audio, video, or picture data between the camera and the computing device through the failsafe circuit.

Figure 4:
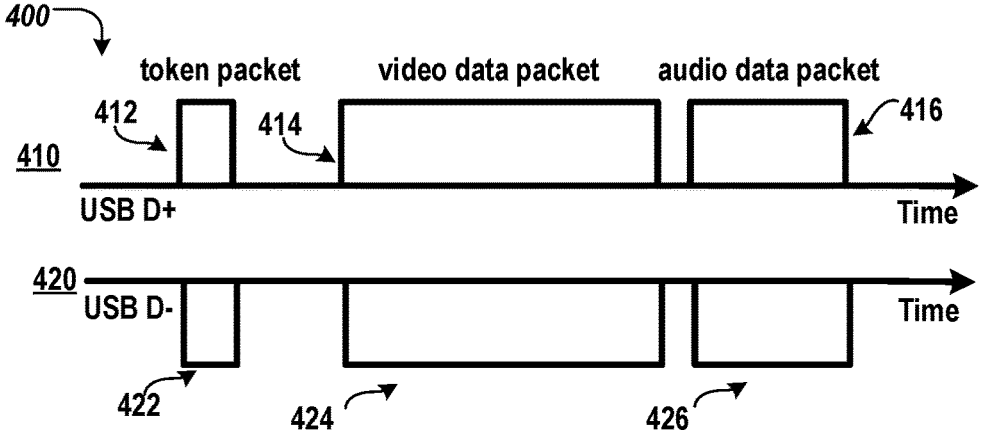
FIG. 4 is a diagram of example signals for a camera that is recording.

FIG. 4 is a diagram of example signals 400 for a camera that is recording. The signals 400 refer to a failsafe circuit monitoring transmission of data between a camera and a computing device. The signals 400 include two data lines 410 and 420 that are monitored for data passing between the camera and the computing device through the failsafe circuit.

The data line 410 represents a USB D+ signal of the camera and the data line 420 represents a USB D− signal of the camera. Referring to FIG. 4, the data lines 410 and 420 each include multiple data packets. The multiple data packets may each include states of ones, zeroes, or any combination thereof. For example, the data line 410 includes a first token communication packet 412, a second data packet 414, and a third data packet 416. The first communication packet 412 is present for a short period of time, the second data packet 414 is present for a long period of time, and the third data packet 416 is present for a period of time greater than the first communication packet 412 but less than the second data packet 414. In this instance, the first communication packet 412 may be identified by the failsafe circuit as a communication packet. The second data packet 414 may be identified by the failsafe circuit as a transmission of video data between the camera and the computing device. The third data packet 416 may be identified by the failsafe circuit as a transmission of audio data between the camera and the computing device.

Similar to data line 410, the data line 420 includes a first token communication packet 422, a second data packet 424, and a third data packet 426. The first token communication packet 422 is present for a short period of time. The second data packet 424 is present for a longer period of time. The third data packet 426 is present for a period of time greater than the first token communication packet 422 and less than the second data packet 424. In this instance, the first token communication packet 422 may be identified by the failsafe circuit as a communication packet. The second data packet 424 may be identified by the failsafe circuit as a transmission of video data between the camera and the computing device. The third data packet 426 may be identified by the failsafe circuit as a transmission of audio data between the camera and the computing device.

As such, the failsafe circuit may identify that the camera is providing data to the computing device during the period of time in which the second 414 and third data packets 416 are present. In response to identifying the activity of the camera, the failsafe circuit may be configured to provide an indication of the activity. The failsafe circuit may provide multiple indications of activity, such as a first indication for the presence of audio data and a second indication for the presence of video data. Alternatively, or additionally the failsafe circuit may provide a single indication of the transmission of data between the camera and the computing device.

The failsafe circuit may be implemented as, or include combinational logic or a dedicated microprocessor circuit that monitors the states of camera control and/or data lines. The failsafe circuit may also decode communication data packets to determine a device address or communication commands/responses.

Figure 5:
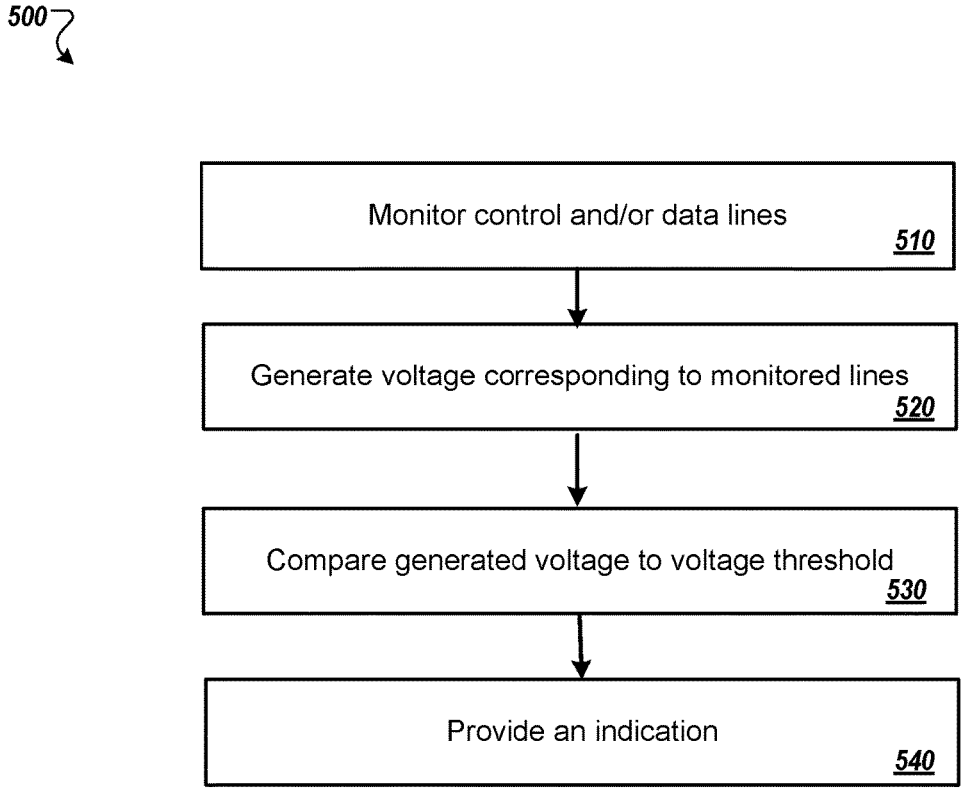
FIG. 5 is a flow chart illustrating an example process for identifying activity using generated voltage.

FIG. 5 is a flow chart illustrating an example process 500 for identifying activity using generated voltage. The process 500 can be performed by failsafe circuits or other computing devices. For example, operations of the process 500 can be performed by failsafe circuit 150B of FIG. 1B. In another example, the operations of process 500 can be performed by failsafe circuit 150C of FIG. 1C.

At step 510, the failsafe circuit is configured to monitor control and/or data lines. The failsafe circuit can be configured to monitor data and signal transmission between a camera and a computing device, within the camera, between the camera and peripheral devices, or any combination thereof. The failsafe circuit can be used to monitor sensors of the camera at all times. As such, the failsafe circuit may be configured to monitor when the camera is powered, when data is transferred to or from the camera, and the like.

At step 520, the failsafe circuit is configured to generate voltage value corresponding to the monitored lines. In some implementations, the failsafe circuit may generate a voltage value based on a signal detected on the monitored line. For example, the failsafe circuit can generate a voltage value based on an average voltage of the signal, an integrated power of the signal, a root-mean-squared value of the signal, a duration of the signal (e.g., the amount of time the voltage of the signal exceeds a particular voltage value), or other features of the detected signal. The failsafe circuit may be configured to persistently generate voltage corresponding to the monitored lines. The failsafe circuit can be configured to generate the voltage in real time or near-real time. The failsafe circuit may be integrated into the hardware of the camera. For example, the failsafe circuit may be inline with an image sensor or amplifier of the camera (e.g., inline with the power to the image sensor or interface logic).

The failsafe circuit may be implemented as a physical device that may be locally actuated to disable the failsafe circuit. For example, the failsafe circuit can be implemented as a jumper cable between the camera and the computing device. In this instance, the failsafe circuit may be disabled via physical, user interaction, but not disabled from a remote location via software.

At step 530, the failsafe circuit is configured to compare the generated voltage value to a voltage threshold. The comparison may be indicative of whether or not the camera is active. For example, the failsafe circuit may determine that the generated voltage does not satisfy (e.g., is not greater than) the voltage threshold. In this instance, the failsafe circuit may determine that the camera is not active. In another example, the failsafe circuit may determine that the generated voltage does satisfy (e.g., is greater than) the voltage threshold. In this instance, the failsafe circuit may determine that the camera is active, (e.g., powered on, transmitting audio data, transmitting video data, etc.). The voltage threshold may include a predetermined amount of voltage, a predetermined amount of time that the predetermined amount of voltage is present (e.g., the duration), and the like.

At step 540, the failsafe circuit is configured to provide an indication. The failsafe circuit may determine that the generated voltage satisfies the predetermined voltage threshold. As such, the failsafe circuit provides an indication that the camera is active. For example, the failsafe circuit can provide a visual indication that the camera is powered on or transmitting data by turning on an LED light. In another example, the failsafe circuit can provide an audial indication that the camera is powered on or transmitting data by emitting a predetermined sound via a speaker.

In some aspects, the failsafe circuit is configured to trigger a monostable section or count down circuit. The monostable section can be triggered for a predetermined period of time and used to provide the indication for the predetermined period of time, (e.g., to turn the LED light on for the predetermined period of time). The monostable section may be triggered for a period of time proportional to a time that the camera is capturing video data. The monostable section may be triggered so that when the camera is activated for a brief period of time, (i.e., less than a second), the LED light may be turned on for an observable period of time, (i.e., five seconds). Therefore, the triggering of a monostable section or count down circuit can enable the failsafe circuit to address scenarios in which an adverse party attempts to capture small amounts of camera activity, such as a single image frame.

The failsafe circuit may be used to supplement preexisting indicator control of the camera. As such, the failsafe circuit may be configured to indicate a "true" state of camera activity. The failsafe circuit can be configured to provide indications when the generated voltage satisfies the predetermined voltage threshold, but the preexisting indicator control of the camera does not detect camera activity. Therefore, the failsafe circuit can be used to indicate when the camera is in a "true" state of activity when compared to the preexisting indicator control.

Figure 6:
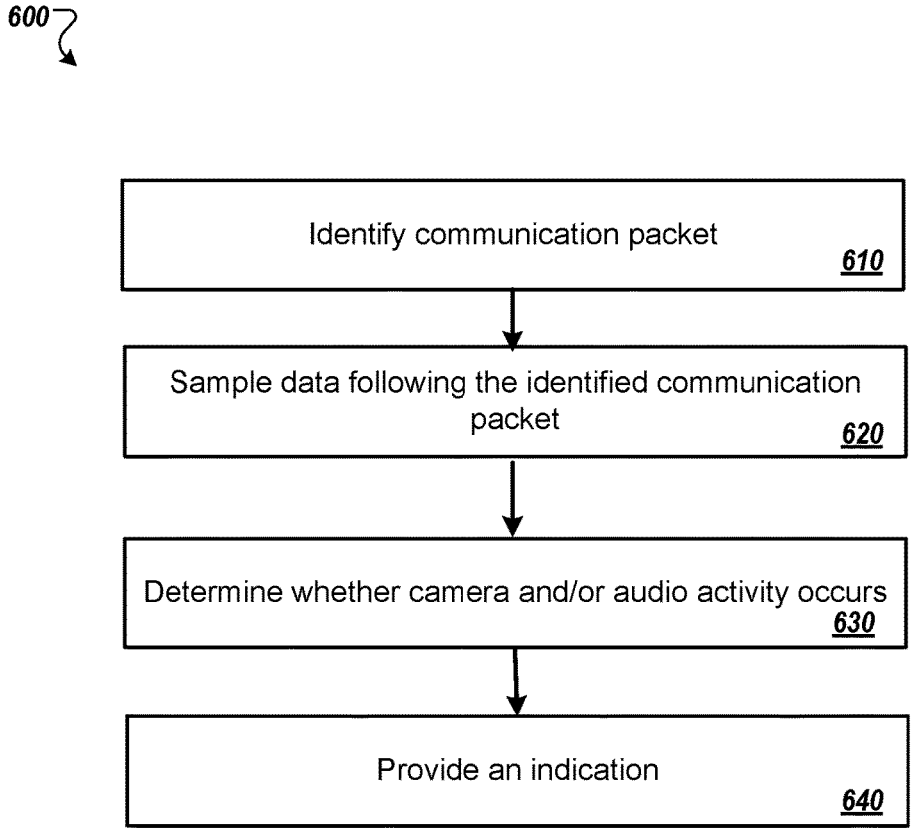
FIG. 6 is a flow chart illustrating an example process for identifying activity using sampled data.

FIG. 6 is a flow chart illustrating an example process 600 for identifying activity using sampled data. The process 600 can be performed by failsafe circuits or other computing devices. For example, operations of the process 600 can be performed by failsafe circuit 150B of FIG. 1B. In another example, the operations of process 600 can be performed by failsafe circuit 150C of FIG. 1C.

At step 610, the failsafe circuit is configured to identify a communication packet. The failsafe circuit may be configured to monitor data lines between a camera and a computing device. The failsafe circuit can be configured to persistently monitor the data lines for predetermined communication packets. As such, the failsafe circuit may compare the monitored data to a predetermined voltage threshold to determine whether or not a communication packet is present.

At step 620, the failsafe circuit is configured to sample data following the identified communication packet. The failsafe circuit is configured to sample data on the data line following the identification of the communication packet. The data line may be sampled for a predetermined period of time. The data line may also be sampled for a period of time based on a number of previously identified communication packets.

At step 630, the failsafe circuit is configured to determine whether camera and/or video activity occurs. The failsafe circuit may be configured to compare the sampled data to predetermined audio and/or video data signals. The predetermined audio and video data may each include a particular voltage and minimum period of time that the data is transmitted.

At step 640, the failsafe circuit is configured to provide an indication. The failsafe circuit may be configured to provide an indication in response to determining that camera and/or video activity is present. For example, if the failsafe circuit determines that audio/video data is transmitted from the camera to a computing device, the failsafe circuit may provide the indication. The failsafe circuit can be configured to provide a visual or audial indication that the camera is active. For example, the failsafe circuit can provide a visual indication that the camera is active by turning on an LED light. In another example, the failsafe circuit can provide an audial indication that the camera is active by emitting a predetermined sound via a speaker.

Figure 7:
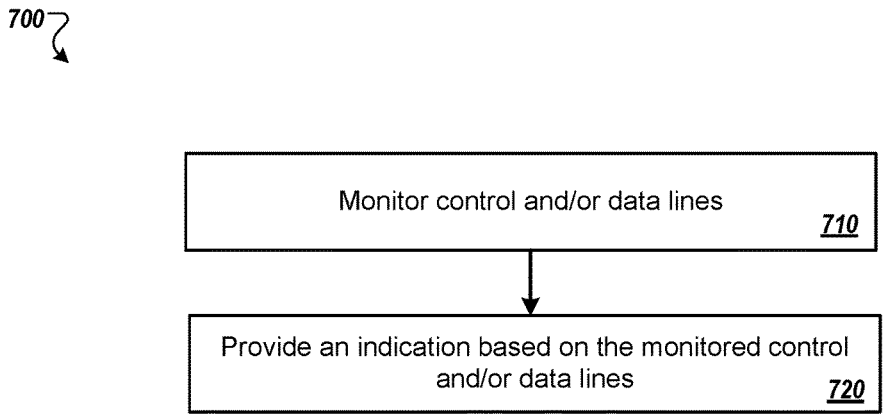
FIG. 7 is a flow chart illustrating an example process for identifying camera operation.

FIG. 7 is a flow chart illustrating an example process 700 for identifying camera operation. The process 700 can be performed by failsafe circuits or other computing devices. For example, operations of the process 700 can be performed by failsafe circuit 150B of FIG. 1B. In another example, the operations of process 700 can be performed by failsafe circuit 150C of FIG. 1C.

At step 710, the failsafe circuit is configured to monitor control and/or data lines. The failsafe circuit may be implemented using combinational logic, a dedicated microprocessor, or by analog methods. The failsafe circuit can be configured to monitor data and signal transmission between a camera and a computing device, within the camera, between the camera and peripheral devices, or any combination thereof. The failsafe circuit can be used to monitor sensors of the camera at all times. As such, the failsafe circuit may be configured to monitor when the camera is powered, when data is transferred to or from the camera, and the like.

At step 720, the failsafe circuit is configured to provide an indication. The failsafe circuit may provide the indication based on the monitored control and/or data lines. The failsafe circuit may determine that the generated voltage satisfies the predetermined voltage threshold. As such, the failsafe circuit provides an indication that the camera is active. For example, the failsafe circuit can provide a visual indication that the camera is powered on or transmitting data by turning on an LED light. In another example, the failsafe circuit can provide an audial indication that the camera is powered on or transmitting data by emitting a predetermined sound via a speaker.

In some aspects, the failsafe circuit is configured to trigger a monostable section or count down circuit. The monostable section can be triggered for a predetermined period of time and used provide the indication for the predetermined period of time, (e.g., to turn the LED light on for the predetermined period of time). The monostable section may be triggered for a period of time proportional to a time that the camera is capturing video data. The monostable section may be triggered so that when the camera is activated for a brief period of time, (i.e., less than a second), the LED light may be turned on for an observable period of time, (i.e., five seconds). Therefore, the triggering of a monostable section or count down circuit can enable the failsafe circuit to address scenarios in which an adverse party attempts to capture small amounts of camera activity, such as a single image frame.

The failsafe circuit may monitor the camera activity indicator and compare actual camera operation with indicated camera operation. The comparison may be used to alert a user to camera operation not displayed by the activity indicator or to prevent camera operation when the activity indicator is inhibited. A number of implementations have been described. Nevertheless, it will be understood that various modifications may be made without departing from the spirit and scope of the disclosure. For example, various forms of the flows shown above may be used, with steps re-ordered, added, or removed.

Figure 8:
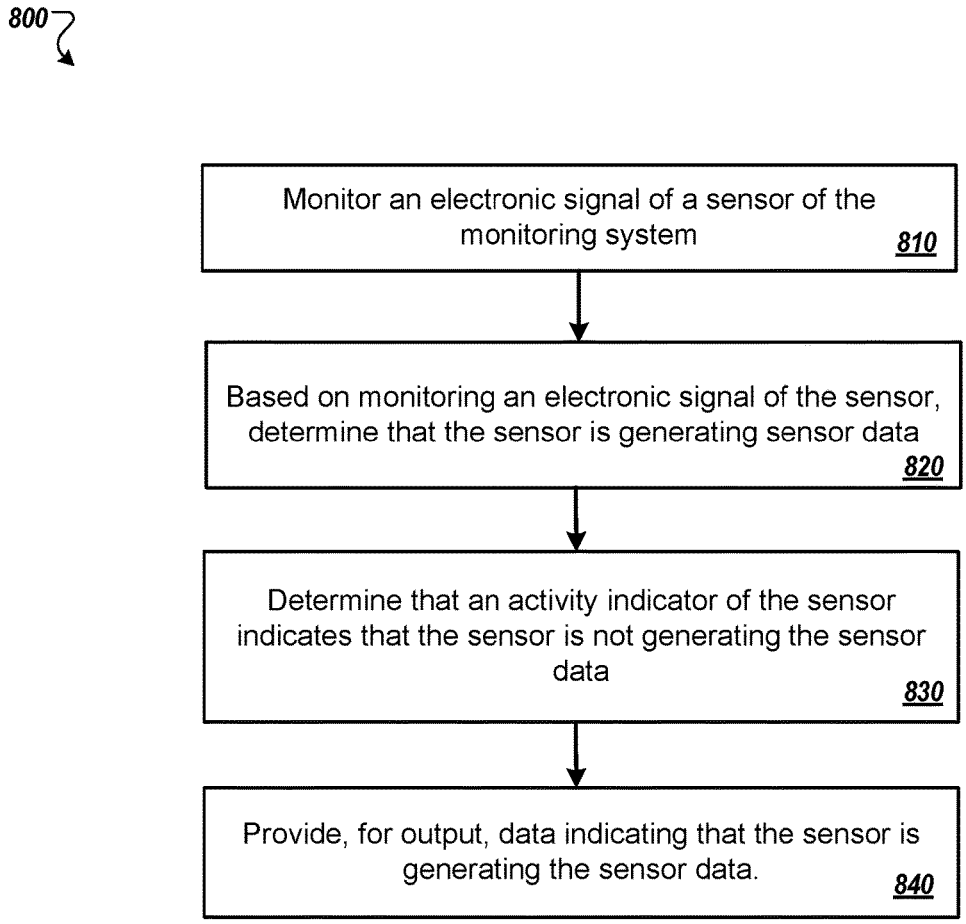
FIG. 8 is a flow chart illustrating an example process for identifying camera operation by a monitoring system.

FIG. 8 is a flow chart illustrating an example process 800 for identifying camera operation by a monitoring system. The process 800 can be performed by one or more components of a monitoring system, for example, the monitoring system 900 of FIG. 9. Briefly, process 800 includes: monitoring an electronic signal of a sensor of a monitoring system (810); based on monitoring an electronic signal of the sensor, determining that the sensor is generating sensor data (820); determining that an activity indicator of the sensor indicates that the sensor is not generating the sensor data (830); and providing, for output, data indicating that the sensor is generating the sensor data (840).

In more detail, at step 810, the monitoring system monitors an electronic signal of a sensor of the monitoring system. For example, the monitoring system that performs the process 800 can be configured to monitor a property and can include one or more of a sensor, a failsafe circuit, and a monitor control unit. Though a particular operation may be described below as being performed by the failsafe circuit, in some implementations, the monitor control unit or another component of the monitoring system (e.g., a server, computer system, or other electronic device) can perform that operation. Similarly, though a particular operation may be described below as being performed by the monitor control unit, in some implementations, the failsafe circuit, or another component of the monitoring system (e.g., a server, computer system, or other electronic device) can perform that operation.

The sensor can be, for example, a camera, a microphone, or another recording device configured to generate sensor data. If the sensor is a camera, the sensor data may be image or video data. If the sensor is a microphone, the sensor data may be audio data. In some cases, the sensor data may include both video data generated by a camera and audio data generated by a microphone.

The failsafe circuit can be, for example, the failsafe circuit 150B of FIG. 1B, the failsafe circuit 150C of FIG. 1C, or another computing device. In some implementations, the failsafe circuit is included in the sensor (e.g., the failsafe circuit 150B of FIG. 1B). In some implementations, the failsafe circuit and the sensor are separate components (e.g., the failsafe circuit 150C and the camera 104 of FIG. 1C).

The monitor control unit can be, for example, the computer system 140 of FIGS. 1B and 1C. The monitor control unit can also be the control unit 910 of FIG. 9. The monitor control unit communicates with the sensor and the failsafe circuit.

In step 810, the failsafe circuit can be configured to monitor an electronic signal of the sensor. The electronic signal of the sensor can be, for example, image, video, or audio data generated by the sensor. The electronic signal can also be a communication signal from the sensor to the monitor control unit. For example, the electronic signal of the sensor can be an output signal of the sensor that includes a data packet.

In some examples, the signal of the sensor is a signal indicating that a component of the sensor is enabled. The component of the sensor can be, for example, a power supply of the sensor, a microphone component of an integrated camera-microphone sensor, or an image sensor component of a camera sensor. In some examples, the electronic signal of the sensor is a signal indicating that the sensor is enabled and generating data. In some examples, the electronic signal is a signal indicating whether one or more components of the sensor are receiving power.

At step 820, based on monitoring an electronic signal of the sensor, the monitoring system determines that the sensor is generating sensor data.

In some implementations, the monitoring system can determine that the sensor is generating sensor data by comparing the electronic signal of the sensor to a predetermined voltage threshold. For example, the failsafe circuit can be configured to monitor an electronic signal of the sensor by monitoring a voltage of the electronic signal. Based on the voltage of the electronic signal, the failsafe circuit can generate a voltage value. For example, the failsafe circuit can generate a voltage based on an average voltage, an average power, or a root-mean-squared voltage of the electronic signal. The failsafe circuit can then compare the voltage value to a voltage threshold. If the failsafe circuit determines that the voltage value satisfies the voltage threshold (e.g., the voltage value is above a lower-limit voltage threshold, or below an upper-limit voltage threshold), the failsafe circuit can determine that the sensor is generating sensor data.

In some implementations, the failsafe circuit can generate the voltage threshold during periods when the monitoring system is aware that the sensor is generating sensor data, for instance, when the monitoring system has requested that the sensor generate sensor data. For example, the monitoring system may request that the camera capture video data. While the camera is capturing and outputting the video data signal, the failsafe circuit can monitor the output data signal of the camera and measure the voltage. The failsafe circuit can generate a voltage threshold based on the voltage measured while the monitoring system is aware that the sensor is capturing video data (e.g., while the failsafe circuit receives an indication that the sensor is generating sensor data). The failsafe circuit can then use this voltage threshold to compare to a voltage value of the electronic signal of the camera at a later time to determine whether the camera may be generating video data without the monitoring system being aware.

In some implementations, the failsafe circuit is configured to determine that the sensor is generating sensor data by identifying data packets detected in the electronic signal of the sensor. For example, if the electronic signal of the sensor is an output signal of the sensor, the failsafe circuit can be configured to determine that the sensor is generating the sensor data based on monitoring the output signal of the sensor and determining that the output signal includes a data packet.

In some examples, the failsafe circuit can monitor the electronic signal of a sensor to identify a token or handshake packet indicating that the sensor and the control unit are communicating. If the failsafe circuit also identifies additional data along with the token packet (e.g., a video data packet, an audio data packet, or another data packet), the failsafe circuit can determine that the sensor is generating sensor data.

In some examples, the failsafe circuit identifies data packets by sampling the electronic signal of the sensor at a particular frequency. For instance, the failsafe circuit can be configured to determine a frequency of token packets transmitted between the sensor and the monitor control unit. The failsafe circuit can then monitor the electronic signal of the sensor at a particular frequency that is greater than the frequency of the token packets being transmitted. By monitoring the electronic signal of the sensor at a frequency greater than that of the token packets, the failsafe circuit can determine whether the electronic signal includes any additional data packets.

In some implementations, the failsafe circuit can identify additional detected data packets as video data, audio data, or other sensor data. For example, the failsafe circuit may determine whether the data is video, audio, or other data based on the duration of the packet, a voltage or power related to the packet (e.g., the average power, root-mean-squared voltage) or another feature of the data packet.

For example, the sensor can be a camera, where the failsafe circuit determines that the camera is generating data by determining that the electronic signal of the camera includes the token packets and video data. Similarly, the sensor can be a microphone, where the failsafe circuit determines that the microphone is generating data by determining that the electronic signal of the microphone includes the token packet and audio data.

In some implementations, where the electronic signal of the sensor is a signal indicating whether a component of the sensor is receiving power, the failsafe circuit determines that the sensor is generating the sensor data by determining that the electronic signal of the sensor indicates that the component of the sensor is receiving power.

In some implementations, the electronic signal of the sensor can be a signal indicating whether the sensor or a component of the sensor is enabled. The component can be, for instance, a power supply, an image sensor, or another sensor component. In these cases, if the sensor or the component of the sensor is enabled, the sensor may be generating data. As a result, the failsafe circuit can determine that the sensor is generating sensor data based on determining that the electronic signal indicates that the sensor or the component is enabled.

In some examples, the electronic sensor is a signal indicating that the sensor is enabled and generating data and the failsafe circuit determines that the sensor is generating the sensor data by monitoring the electronic signal of the sensor indicating that the sensor is enabled and generating data.

If the failsafe circuit determines that the sensor is generating sensor data, the circuit can generate data indicating that the sensor is operating. For example, the failsafe circuit can provide, for output, data indicating that the sensor is generating the sensor data. In some implementations, the monitor control unit receives the data indicating that the sensor is generating sensor data from the failsafe circuit.

At step 830, the monitoring system determines that an activity indicator of the sensor indicates that the sensor is not generating the sensor data. The activity indicator can be, for example, a setting or signal of the sensor provided by the sensor to the failsafe circuit or to the monitor control unit. In some instances, the activity indicator may cause an LED of the sensor to light.

An activity indicator that indicates that the sensor is not generating the sensor data can mean that the monitor control unit did not generate a request for the sensor to generate the sensor data or that the monitoring system is not aware that the sensor is generating sensor data. If the sensor is generating sensor data, but the activity indicator indicates that the sensor is not generating data, the sensor may be under the control of an adverse third-party.

At step 840, based on determining that the activity indicator of the sensor indicates that the sensor is not generating the sensor data, the system provides, for output, data indicating that the sensor is generating the sensor data. In some implementations, the monitoring system provides for output data indicating that the sensor is generating the sensor data and that the activity indicator indicates that the sensor is not generating the sensor data.

For example, the monitor control unit or the failsafe circuit may provide, for output to a sensor, data providing an instruction to activate a notification light of the sensor (e.g., indicating that the sensor is operating).

In some implementations, the monitor control unit or failsafe circuit may provide, for output to a resident of the property, a notification that the camera is operating. For example, the monitor control unit may send a message to a mobile device of the resident. The monitor control unit may also send an alert to a computing device of the resident through a software application.

In some examples, if the monitoring system determines that the monitor control unit did not generate a request for the sensor to generate data or was not aware that the sensor was generating data, the system may disable the sensor, prohibit it from generating the sensor data, or prevent it from transmitting the sensor data. A sensor that is generating data when the system is not aware (e.g., when the activity indicator indicates that the sensor is not generating data) may be operating under the control of an adverse third-party. The monitoring system may disable the sensor or otherwise prevent the sensor from transmitting data to block the third-party from surreptitiously operating the sensor.

For example, the sensor of the system may be configured to transmit the sensor data to a network, a host computer, or another computing device. The failsafe circuit may receive, from the monitor control unit, the data indicating that the sensor is generating sensor data, which indicates that the sensor is generating sensor data while the monitoring system was unaware that it was generating data. Based on receiving the data from the monitor control unit, the failsafe circuit can prevent the sensor from transmitting the sensor data.

Figure 9:
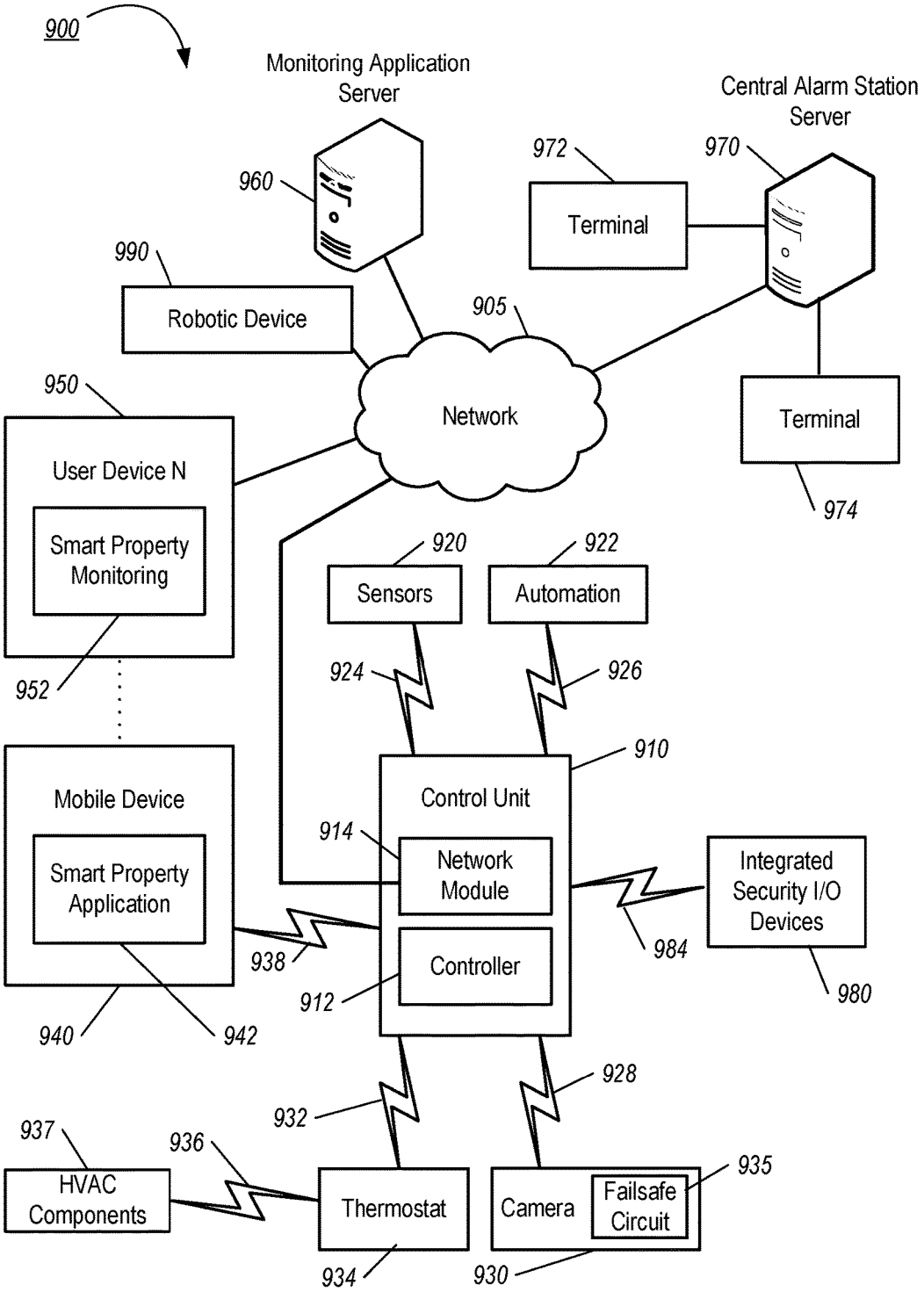
FIG. 9 is a diagram of an example of a property monitoring system.

FIG. 9 is a diagram illustrating an example of a property monitoring system 900. The electronic system 900 includes a network 905, a control unit 910, one or more user devices 940 and 950, a monitoring server 960, and a central alarm station server 970. In some examples, the network 905 facilitates communications between the control unit 910, the one or more user devices 940 and 950, the monitoring server 960, and the central alarm station server 970.

The network 905 is configured to enable exchange of electronic communications between devices connected to the network 905. For example, the network 905 may be configured to enable exchange of electronic communications between the control unit 910, the one or more user devices 940 and 950, the monitoring server 960, and the central alarm station server 970. The network 905 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 905 may include multiple networks or subnetworks, each of which may include, for example, a wired or wireless data pathway. The network 905 may include a circuit-switched network, a packet-switched data network, or any other network able to carry electronic communications (e.g., data or voice communications). For example, the network 905 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 905 may include one or more networks that include wireless data channels and wireless voice channels. The network 905 may be a wireless network, a broadband network, or a combination of networks including a wireless network and a broadband network.

The control unit 910 includes a controller 912 and a network module 914. The controller 912 is configured to control a control unit monitoring system (e.g., a control unit system) that includes the control unit 910. In some examples, the controller 912 may include a processor or other control circuitry configured to execute instructions of a program that controls operation of a control unit system. In these examples, the controller 912 may be configured to receive input from sensors, flow meters, or other devices included in the control unit system and control operations of devices included in the household (e.g., speakers, lights, doors, etc.). For example, the controller 912 may be configured to control operation of the network module 914 included in the control unit 910.

The network module 914 is a communication device configured to exchange communications over the network 905. The network module 914 may be a wireless communication module configured to exchange wireless communications over the network 905. For example, the network module 914 may be a wireless communication device configured to exchange communications over a wireless data channel and a wireless voice channel. In this example, the network module 914 may transmit alarm data over a wireless data channel and establish a two-way voice communication session over a wireless voice channel. The wireless communication device may include one or more of a LTE module, a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 914 also may be a wired communication module configured to exchange communications over the network 905 using a wired connection. For instance, the network module 914 may be a modem, a network interface card, or another type of network interface device. The network module 914 may be an Ethernet network card configured to enable the control unit 910 to communicate over a local area network and/or the Internet. The network module 914 also may be a voice band modem configured to enable the alarm panel to communicate over the telephone lines of Plain Old Telephone Systems (POTS).

The control unit system that includes the control unit 910 includes one or more sensors. For example, the monitoring system may include multiple sensors 920. The sensors 920 may include a lock sensor, a contact sensor, a motion sensor, or any other type of sensor included in a control unit system. The sensors 920 also may include an environmental sensor, such as a temperature sensor, a water sensor, a rain sensor, a wind sensor, a light sensor, a smoke detector, a carbon monoxide detector, an air quality sensor, etc. The sensors 920 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the health monitoring sensor can be a wearable sensor that attaches to a user at the property. The health monitoring sensor can collect various health data, including pulse, heart-rate, respiration rate, sugar or glucose level, bodily temperature, or motion data.

The sensors 920 can also include a radio-frequency identification (RFID) sensor that identifies a particular article that includes a pre-assigned RFID tag.

The control unit 910 communicates with the property automation controls 922 and a camera 930 to perform monitoring. The property automation controls 922 are connected to one or more devices that enable automation of actions at the property. For instance, the property automation controls 922 may be connected to one or more lighting systems and may be configured to control operation of the one or more lighting systems. Also, the property automation controls 922 may be connected to one or more electronic locks at the property and may be configured to control operation of the one or more electronic locks (e.g., control Z-Wave locks using wireless communications in the Z-Wave protocol). Further, the property automation controls 922 may be connected to one or more appliances at the property and may be configured to control operation of the one or more appliances. The property automation controls 922 may include multiple modules that are each specific to the type of device being controlled in an automated manner. The property automation controls 922 may control the one or more devices based on commands received from the control unit 910. For instance, the property automation controls 922 may cause a lighting system to illuminate an area to provide a better image of the area when captured by a camera 930.

The camera 930 may be a video/photographic camera or other type of optical sensing device configured for capturing image data. For instance, the camera 930 may be configured to capture images of an area within a building or property monitored by the control unit 910. The camera 930 may be configured to capture single, static images of the area and also video images of the area in which multiple images of the area are captured at a relatively high frequency (e.g., thirty images per second). The camera 930 may be controlled based on commands received from the control unit 910.

The camera 930 may be triggered by several different types of techniques. For instance, a Passive Infra-Red (PIR) motion sensor may be built into the camera 930 and used to trigger the camera 930 to capture one or more images when motion is detected. The camera 930 also may include a microwave motion sensor built into the camera and used to trigger the camera 930 to capture one or more images when motion is detected. The camera 930 may have a "normally open" or "normally closed" digital input that can trigger capture of one or more images when external sensors (e.g., the sensors 920, PIR, door/window, etc.) detect motion or other events. In some implementations, the camera 930 receives a command to capture an image when external devices detect motion or another potential alarm event. The camera 930 may receive the command from the controller 912 or directly from one of the sensors 920.

In some examples, the camera 930 triggers integrated or external illuminators (e.g., Infra-Red, Z-wave controlled "white" lights, lights controlled by the property automation controls 922, etc.) to improve image quality when the scene is dark. An integrated or separate light sensor may be used to determine if illumination is desired and may result in increased image quality.

The camera 930 may be programmed with any combination of time/day schedules, system "arming state", or other variables to determine whether images should be captured or not when triggers occur. The camera 930 may enter a low-power mode when not capturing images. In this case, the camera 930 may wake periodically to check for inbound messages from the controller 912. The camera 930 may be powered by internal, replaceable batteries if located remotely from the control unit 910. The camera 930 may employ a small solar cell to recharge the battery when light is available. Alternatively, the camera 930 may be powered by the controller's 912 power supply if the camera 930 is co-located with the controller 912.

In some implementations, the camera 930 communicates directly with the monitoring server 960 over the Internet. In these implementations, image data captured by the camera 930 does not pass through the control unit 910 and the camera 930 receives commands related to operation from the monitoring server 960.

In some implementations, the camera 930 includes a failsafe circuit 935. The failsafe circuit 935 can monitor data communication between the camera 930 and a computer system (e.g., the control unit 910, the monitoring server 960) to detect recording activity based on detection of various signals, packets, or other data. The failsafe circuit 935 can provide an indication of recording activity to a peripheral associated with the camera 930, to a computer system (e.g., the control unit 910, the monitoring server 960), or to a user device 940, 950. In some implementations, the failsafe circuit 935 provides the described functionality, but is separate from the camera 930. The operation and configuration of the fail safe circuit 935 is described in greater detail in FIGS. 1A-7.

The system 900 also includes thermostat 934 to perform dynamic environmental control at the property. The thermostat 934 is configured to monitor temperature and/or energy consumption of an HVAC system associated with the thermostat 934, and is further configured to provide control of environmental (e.g., temperature) settings. In some implementations, the thermostat 934 can additionally or alternatively receive data relating to activity at a property and/or environmental data at a property, e.g., at various locations indoors and outdoors at the property. The thermostat 934 can directly measure energy consumption of the HVAC system associated with the thermostat, or can estimate energy consumption of the HVAC system associated with the thermostat 934, for example, based on detected usage of one or more components of the HVAC system associated with the thermostat 934. The thermostat 934 can communicate temperature and/or energy monitoring information to or from the control unit 910 and can control the environmental (e.g., temperature) settings based on commands received from the control unit 910.

In some implementations, the thermostat 934 is a dynamically programmable thermostat and can be integrated with the control unit 910. For example, the dynamically programmable thermostat 934 can include the control unit 910, e.g., as an internal component to the dynamically programmable thermostat 934. In addition, the control unit 910 can be a gateway device that communicates with the dynamically programmable thermostat 934. In some implementations, the thermostat 934 is controlled via one or more property automation controls 922.

A module 937 is connected to one or more components of an HVAC system associated with a property, and is configured to control operation of the one or more components of the HVAC system. In some implementations, the module 937 is also configured to monitor energy consumption of the HVAC system components, for example, by directly measuring the energy consumption of the HVAC system components or by estimating the energy usage of the one or more HVAC system components based on detecting usage of components of the HVAC system. The module 937 can communicate energy monitoring information and the state of the HVAC system components to the thermostat 934 and can control the one or more components of the HVAC system based on commands received from the thermostat 934.

In some examples, the system 900 further includes one or more robotic devices 990. The robotic devices 990 may be any type of robots that are capable of moving and taking actions that assist in property monitoring. For example, the robotic devices 990 may include drones that are capable of moving throughout a property based on automated control technology and/or user input control provided by a user. In this example, the drones may be able to fly, roll, walk, or otherwise move about the property. The drones may include helicopter type devices (e.g., quad copters), rolling helicopter type devices (e.g., roller copter devices that can fly and also roll along the ground, walls, or ceiling) and land vehicle type devices (e.g., automated cars that drive around a property). In some cases, the robotic devices 990 may be robotic devices 990 that are intended for other purposes and merely associated with the system 900 for use in appropriate circumstances. For instance, a robotic vacuum cleaner device may be associated with the monitoring system 900 as one of the robotic devices 990 and may be controlled to take action responsive to monitoring system events.

In some examples, the robotic devices 990 automatically navigate within a property. In these examples, the robotic devices 990 include sensors and control processors that guide movement of the robotic devices 990 within the property. For instance, the robotic devices 990 may navigate within the property using one or more cameras, one or more proximity sensors, one or more gyroscopes, one or more accelerometers, one or more magnetometers, a global positioning system (GPS) unit, an altimeter, one or more sonar or laser sensors, and/or any other types of sensors that aid in navigation about a space. The robotic devices 990 may include control processors that process output from the various sensors and control the robotic devices 990 to move along a path that reaches the desired destination and avoids obstacles. In this regard, the control processors detect walls or other obstacles at the property and guide movement of the robotic devices 990 in a manner that avoids the walls and other obstacles.

In addition, the robotic devices 990 may store data that describes attributes of the property. For instance, the robotic devices 990 may store a floorplan and/or a three-dimensional model of the property that enables the robotic devices 990 to navigate the property. During initial configuration, the robotic devices 990 may receive the data describing attributes of the property, determine a frame of reference to the data (e.g., a property or reference location at the property), and navigate the property based on the frame of reference and the data describing attributes of the property. Further, initial configuration of the robotic devices 990 also may include learning of one or more navigation patterns in which a user provides input to control the robotic devices 990 to perform a specific navigation action (e.g., fly to an upstairs bedroom and spin around while capturing video and then return to a property charging base). In this regard, the robotic devices 990 may learn and store the navigation patterns such that the robotic devices 990 may automatically repeat the specific navigation actions upon a later request.

In some examples, the robotic devices 990 may include data capture and recording devices. In these examples, the robotic devices 990 may include one or more cameras, one or more motion sensors, one or more microphones, one or more biometric data collection tools, one or more temperature sensors, one or more humidity sensors, one or more air flow sensors, and/or any other types of sensors that may be useful in capturing monitoring data related to the property and users at the property. The one or more biometric data collection tools may be configured to collect biometric samples of a person at the property with or without contact of the person. For instance, the biometric data collection tools may include a fingerprint scanner, a hair sample collection tool, a skin cell collection tool, and/or any other tool that allows the robotic devices 990 to take and store a biometric sample that can be used to identify the person (e.g., a biometric sample with DNA that can be used for DNA testing).

In some implementations, the robotic devices 990 may include output devices. In these implementations, the robotic devices 990 may include one or more displays, one or more speakers, and/or any type of output devices that allow the robotic devices 990 to communicate information to a nearby user.

The robotic devices 990 also may include a communication module that enables the robotic devices 990 to communicate with the control unit 910, each other, and/or other devices. The communication module may be a wireless communication module that allows the robotic devices 990 to communicate wirelessly. For instance, the communication module may be a Wi-Fi module that enables the robotic devices 990 to communicate over a local wireless network at the property. The communication module further may be a 900 MHz wireless communication module that enables the robotic devices 990 to communicate directly with the control unit 910. Other types of short-range wireless communication protocols, such as Bluetooth, Bluetooth LE, Z-wave, Zigbee, etc., may be used to allow the robotic devices 990 to communicate with other devices at the property. In some implementations, the robotic devices 990 may communicate with each other or with other devices of the system 900 through the network 905.

The robotic devices 990 further may include processor and storage capabilities. The robotic devices 990 may include any suitable processing devices that enable the robotic devices 990 to operate applications and perform the actions described throughout this disclosure. In addition, the robotic devices 990 may include solid state electronic storage that enables the robotic devices 990 to store applications, configuration data, collected sensor data, and/or any other type of information available to the robotic devices 990.

The robotic devices 990 are associated with one or more charging stations. The charging stations may be located at predefined property base or reference locations at the property. The robotic devices 990 may be configured to navigate to the charging stations after completion of tasks needed to be performed for the monitoring system 900. For instance, after completion of a monitoring operation or upon instruction by the control unit 910, the robotic devices 990 may be configured to automatically fly to and land on one of the charging stations. In this regard, the robotic devices 990 may automatically maintain a fully charged battery in a state in which the robotic devices 990 are ready for use by the monitoring system 900.

The charging stations may be contact based charging stations and/or wireless charging stations. For contact based charging stations, the robotic devices 990 may have readily accessible points of contact that the robotic devices 990 are capable of positioning and mating with a corresponding contact on the charging station. For instance, a helicopter type robotic device may have an electronic contact on a portion of its landing gear that rests on and mates with an electronic pad of a charging station when the helicopter type robotic device lands on the charging station. The electronic contact on the robotic device may include a cover that opens to expose the electronic contact when the robotic device is charging and closes to cover and insulate the electronic contact when the robotic device is in operation.

For wireless charging stations, the robotic devices 990 may charge through a wireless exchange of power. In these cases, the robotic devices 990 need only locate themselves closely enough to the wireless charging stations for the wireless exchange of power to occur. In this regard, the positioning needed to land at a predefined property base or reference location at the property may be less precise than with a contact based charging station. Based on the robotic devices 990 landing at a wireless charging station, the wireless charging station outputs a wireless signal that the robotic devices 990 receive and convert to a power signal that charges a battery maintained on the robotic devices 990.

In some implementations, each of the robotic devices 990 has a corresponding and assigned charging station such that the number of robotic devices 990 equals the number of charging stations. In these implementations, the robotic devices 990 always navigate to the specific charging station assigned to that robotic device. For instance, a first robotic device may always use a first charging station and a second robotic device may always use a second charging station.

In some examples, the robotic devices 990 may share charging stations. For instance, the robotic devices 990 may use one or more community charging stations that are capable of charging multiple robotic devices 990. The community charging station may be configured to charge multiple robotic devices 990 in parallel. The community charging station may be configured to charge multiple robotic devices 990 in serial such that the multiple robotic devices 990 take turns charging and, when fully charged, return to a predefined property base or reference location at the property that is not associated with a charger. The number of community charging stations may be less than the number of robotic devices 990.

Also, the charging stations may not be assigned to specific robotic devices 990 and may be capable of charging any of the robotic devices 990. In this regard, the robotic devices 990 may use any suitable, unoccupied charging station when not in use. For instance, when one of the robotic devices 990 has completed an operation or is in need of battery charge, the control unit 910 references a stored table of the occupancy status of each charging station and instructs the robotic device to navigate to the nearest charging station that is unoccupied.

The system 900 further includes one or more integrated security devices 980. The one or more integrated security devices may include any type of device used to provide alerts based on received sensor data. For instance, the one or more control units 910 may provide one or more alerts to the one or more integrated security input/output devices 980. Additionally, the one or more control units 910 may receive one or more sensor data from the sensors 920 and determine whether to provide an alert to the one or more integrated security input/output devices 980.

The sensors 920, the property automation controls 922, the camera 930, the thermostat 934, and the integrated security devices 980 may communicate with the controller 912 over communication links 924, 926, 928, 932, 938, and 984. The communication links 924, 926, 928, 932, 938, and 984 may be a wired or wireless data pathway configured to transmit signals from the sensors 920, the property automation controls 922, the camera 930, the thermostat 934, and the integrated security devices 980 to the controller 912. The sensors 920, the property automation controls 922, the camera 930, the thermostat 934, and the integrated security devices 980 may continuously transmit sensed values to the controller 912, periodically transmit sensed values to the controller 912, or transmit sensed values to the controller 912 in response to a change in a sensed value.

The communication links 924, 926, 928, 932, 938, and 984 may include a local network. The sensors 920, the property automation controls 922, the camera 930, the thermostat 934, and the integrated security devices 980, and the controller 912 may exchange data and commands over the local network. The local network may include 902.11 "Wi-Fi" wireless Ethernet (e.g., using low-power Wi-Fi chipsets), Z-Wave, Zigbee, Bluetooth, "Homeplug" or other "Powerline" networks that operate over AC wiring, and a Category 5 (CAT5) or Category 6 (CAT6) wired Ethernet network. The local network may be a mesh network constructed based on the devices connected to the mesh network.

The monitoring server 960 is an electronic device configured to provide monitoring services by exchanging electronic communications with the control unit 910, the one or more user devices 940 and 950, and the central alarm station server 970 over the network 905. For example, the monitoring server 960 may be configured to monitor events (e.g., alarm events) generated by the control unit 910. In this example, the monitoring server 960 may exchange electronic communications with the network module 914 included in the control unit 910 to receive information regarding events (e.g., alerts) detected by the control unit 910. The monitoring server 960 also may receive information regarding events (e.g., alerts) from the one or more user devices 940 and 950.

In some examples, the monitoring server 960 may route alert data received from the network module 914 or the one or more user devices 940 and 950 to the central alarm station server 970. For example, the monitoring server 960 may transmit the alert data to the central alarm station server 970 over the network 905.

The monitoring server 960 may store sensor and image data received from the monitoring system and perform analysis of sensor and image data received from the monitoring system. Based on the analysis, the monitoring server 960 may communicate with and control aspects of the control unit 910 or the one or more user devices 940 and 950.

The monitoring server 960 may provide various monitoring services to the system 900. For example, the monitoring server 960 may analyze the sensor, image, and other data to determine an activity pattern of a resident of the property monitored by the system 900. In some implementations, the monitoring server 960 may analyze the data for alarm conditions or may determine and perform actions at the property by issuing commands to one or more of the controls 922, possibly through the control unit 910.

The central alarm station server 970 is an electronic device configured to provide alarm monitoring service by exchanging communications with the control unit 910, the one or more mobile devices 940 and 950, and the monitoring server 960 over the network 905. For example, the central alarm station server 970 may be configured to monitor alerting events generated by the control unit 910. In this example, the central alarm station server 970 may exchange communications with the network module 914 included in the control unit 910 to receive information regarding alerting events detected by the control unit 910. The central alarm station server 970 also may receive information regarding alerting events from the one or more mobile devices 940 and 950 and/or the monitoring server 960.

The central alarm station server 970 is connected to multiple terminals 972 and 974. The terminals 972 and 974 may be used by operators to process alerting events. For example, the central alarm station server 970 may route alerting data to the terminals 972 and 974 to enable an operator to process the alerting data. The terminals 972 and 974 may include general-purpose computers (e.g., desktop personal computers, workstations, or laptop computers) that are configured to receive alerting data from a server in the central alarm station server 970 and render a display of information based on the alerting data. For instance, the controller 912 may control the network module 914 to transmit, to the central alarm station server 970, alerting data indicating that a sensor 920 detected motion from a motion sensor via the sensors 920. The central alarm station server 970 may receive the alerting data and route the alerting data to the terminal 972 for processing by an operator associated with the terminal 972. The terminal 972 may render a display to the operator that includes information associated with the alerting event (e.g., the lock sensor data, the motion sensor data, the contact sensor data, etc.) and the operator may handle the alerting event based on the displayed information.

In some implementations, the terminals 972 and 974 may be mobile devices or devices designed for a specific function. Although FIG. 9 illustrates two terminals for brevity, actual implementations may include more (and, perhaps, many more) terminals.

The one or more authorized user devices 940 and 950 are devices that host and display user interfaces. For instance, the user device 940 is a mobile device that hosts or runs one or more native applications (e.g., the smart property application 942). The user device 940 may be a cellular phone or a non-cellular locally networked device with a display. The user device 940 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 940 may perform functions unrelated to the monitoring system, such as placing personal telephone calls, playing music, playing video, displaying pictures, browsing the Internet, maintaining an electronic calendar, etc.

The user device 940 includes a smart property application 942. The smart property application 942 refers to a software/firmware program running on the corresponding mobile device that enables the user interface and features described throughout. The user device 940 may load or install the smart property application 942 based on data received over a network or data received from local media. The smart property application 942 runs on mobile devices platforms, such as iPhone, iPod touch, Blackberry, Google Android, Windows Mobile, etc. The smart property application 942 enables the user device 940 to receive and process image and sensor data from the monitoring system.

The user device 950 may be a general-purpose computer (e.g., a desktop personal computer, a workstation, or a laptop computer) that is configured to communicate with the monitoring server 960 and/or the control unit 910 over the network 905. The user device 950 may be configured to display a smart property user interface 952 that is generated by the user device 950 or generated by the monitoring server 960. For example, the user device 950 may be configured to display a user interface (e.g., a web page) provided by the monitoring server 960 that enables a user to perceive images captured by the camera 930 and/or reports related to the monitoring system. Although FIG. 9 illustrates two user devices for brevity, actual implementations may include more (and, perhaps, many more) or fewer user devices.

In some implementations, the one or more user devices 940 and 950 communicate with and receive monitoring system data from the control unit 910 using the communication link 938. For instance, the one or more user devices 940 and 950 may communicate with the control unit 910 using various local wireless protocols such as Wi-Fi, Bluetooth, Z-wave, Zigbee, HomePlug (ethernet over power line), or wired protocols such as Ethernet and USB, to connect the one or more user devices 940 and 950 to local security and automation equipment. The one or more user devices 940 and 950 may connect locally to the monitoring system and its sensors and other devices. The local connection may improve the speed of status and control communications because communicating through the network 905 with a remote server (e.g., the monitoring server 960) may be significantly slower.

Although the one or more user devices 940 and 950 are shown as communicating with the control unit 910, the one or more user devices 940 and 950 may communicate directly with the sensors and other devices controlled by the control unit 910. In some implementations, the one or more user devices 940 and 950 replace the control unit 910 and perform the functions of the control unit 910 for local monitoring and long range/offsite communication.

In other implementations, the one or more user devices 940 and 950 receive monitoring system data captured by the control unit 910 through the network 905. The one or more user devices 940, 950 may receive the data from the control unit 910 through the network 905 or the monitoring server 960 may relay data received from the control unit 910 to the one or more user devices 940 and 950 through the network 905. In this regard, the monitoring server 960 may facilitate communication between the one or more user devices 940 and 950 and the monitoring system.

In some implementations, the one or more user devices 940 and 950 may be configured to switch whether the one or more user devices 940 and 950 communicate with the control unit 910 directly (e.g., through link 938) or through the monitoring server 960 (e.g., through network 905) based on a location of the one or more user devices 940 and 950. For instance, when the one or more user devices 940 and 950 are located close to the control unit 910 and in range to communicate directly with the control unit 910, the one or more user devices 940 and 950 use direct communication. When the one or more user devices 940 and 950 are located far from the control unit 910 and not in range to communicate directly with the control unit 910, the one or more user devices 940 and 950 use communication through the monitoring server 960.

Although the one or more user devices 940 and 950 are shown as being connected to the network 905, in some implementations, the one or more user devices 940 and 950 are not connected to the network 905. In these implementations, the one or more user devices 940 and 950 communicate directly with one or more of the monitoring system components and no network (e.g., Internet) connection or reliance on remote servers is needed.

In some implementations, the one or more user devices 940 and 950 are used in conjunction with only local sensors and/or local devices in a house. In these implementations, the system 900 includes the one or more user devices 940 and 950, the sensors 920, the property automation controls 922, the camera 930, and the robotic devices 990. The one or more user devices 940 and 950 receive data directly from the sensors 920, the property automation controls 922, the camera 930, and the robotic devices 990 and sends data directly to the sensors 920, the property automation controls 922, the camera 930, and the robotic devices 990. The one or more user devices 940, 950 provide the appropriate interfaces/processing to provide visual surveillance and reporting.

In other implementations, the system 900 further includes network 905 and the sensors 920, the property automation controls 922, the camera 930, the thermostat 934, and the robotic devices 990 are configured to communicate sensor and image data to the one or more user devices 940 and 950 over network 905 (e.g., the Internet, cellular network, etc.). In yet another implementation, the sensors 920, the property automation controls 922, the camera 930, the thermostat 934, and the robotic devices 990 (or a component, such as a bridge/router) are intelligent enough to change the communication pathway from a direct local pathway when the one or more user devices 940 and 950 are in close physical proximity to the sensors 920, the property automation controls 922, the camera 930, the thermostat 934, and the robotic devices 990 to a pathway over network 905 when the one or more user devices 940 and 950 are farther from the sensors 920, the property automation controls 922, the camera 930, the thermostat 934, the robotic devices 990, and the stair lift module. In some examples, the system leverages GPS information from the one or more user devices 940 and 950 to determine whether the one or more user devices 940 and 950 are close enough to the sensors 920, the property automation controls 922, the camera 930, the thermostat 934, and the robotic devices 990 to use the direct local pathway or whether the one or more user devices 940 and 950 are far enough from the sensors 920, the property automation controls 922, the camera 930, the thermostat 934, and the robotic devices 990 that the pathway over network 905 is required. In other examples, the system leverages status communications (e.g., pinging) between the one or more user devices 940 and 950 and the sensors 920, the property automation controls 922, the camera 930, the thermostat 934, and the robotic devices 990 to determine whether communication using the direct local pathway is possible. If communication using the direct local pathway is possible, the one or more user devices 940 and 950 communicate with the sensors 920, the property automation controls 922, the camera 930, the thermostat 934, and the robotic devices 990 using the direct local pathway. If communication using the direct local pathway is not possible, the one or more user devices 940 and 950 communicate with the sensors 920, the property automation controls 922, the camera 930, the thermostat 934, and the robotic devices 990 using the pathway over network 905.

In some implementations, the system 900 provides end users with access to images captured by the camera 930 to aid in decision making. The system 900 may transmit the images captured by the camera 930 over a wireless WAN network to the user devices 940 and 950. Because transmission over a wireless WAN network may be relatively expensive, the system 900 can use several techniques to reduce costs while providing access to significant levels of useful visual information (e.g., compressing data, down-sampling data, sending data only over inexpensive LAN connections, or other techniques).

In some implementations, a state of the monitoring system and other events sensed by the monitoring system may be used to enable/disable video/image recording devices (e.g., the camera 930). In these implementations, the camera 930 may be set to capture images on a periodic basis when the alarm system is armed in an "away" state, but set not to capture images when the alarm system is armed in a "home" state or disarmed. In addition, the camera 930 may be triggered to begin capturing images when the alarm system detects an event, such as an alarm event, a door-opening event for a door that leads to an area within a field of view of the camera 930, or motion in the area within the field of view of the camera 930. In other implementations, the camera 930 may capture images continuously, but the captured images may be stored or transmitted over a network when needed.

Embodiments of the invention and all of the functional operations described in this specification can be implemented in digital electronic circuitry, analog electronic circuitry, or in computer software, firmware, or hardware, including the structures disclosed in this specification and their structural equivalents, or in combinations of one or more of them. Embodiments of the invention can be implemented as one or more computer program products, e.g., one or more modules of computer program instructions encoded on a non-transitory computer readable medium for execution by, or to control the operation of, data processing apparatus. The computer readable medium can be a machine-readable storage device, a machine-readable storage substrate, a memory device, a composition of matter effecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them. A propagated signal is an artificially generated signal, e.g., a machine-generated electrical, optical, or electromagnetic signal that is generated to encode information for transmission to suitable receiver apparatus.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a tablet computer, a mobile telephone, a personal digital assistant (PDA), a mobile audio player, a Global Positioning System (GPS) receiver, to name just a few. Computer readable media suitable for storing computer program instructions and data include all forms of nonvolatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the invention can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the invention, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Particular embodiments of the invention have been described. Other embodiments are within the scope of the following claims. For example, the steps recited in the claims can be performed in a different order and still achieve desirable results.

What is claimed is:

1. A monitoring system that is configured to monitor a property, the monitoring system comprising:
- a sensor that is configured to generate sensor data;
- a failsafe circuit that is configured to:
  - monitor an electronic signal of the sensor;
  - based on monitoring the electronic signal of the sensor, determine that the sensor is generating the sensor data; and
  - generate data indicating that the sensor is generating the sensor data; and
- a monitor control unit that is configured to:
  - receive the data indicating that the sensor is generating the sensor data;
  - determine that the monitor control unit did not generate a request for the sensor to generate the sensor data or that the monitor control unit is not aware that the sensor is generating sensor data; and
  - based on receiving the data indicating that the sensor is generating the sensor data and based on determining that the monitor control unit did not generate a request for the sensor to generate the sensor data or that the monitor control unit is not aware that the sensor is generating sensor data, provide, for output, data indicating that the sensor is generating the sensor data.

2. The system of claim 1, wherein the failsafe circuit is included in the sensor.

3. The system of claim 1, wherein the failsafe circuit is configured to:
- monitor an electronic signal of the sensor by monitoring a voltage of an electronic signal of the sensor;
- based on the voltage of the electronic signal of the sensor, generate a voltage value;
- compare the voltage value to a voltage threshold;
- determine that the voltage value satisfies the voltage threshold; and
- determine that the sensor is generating the sensor data based on determining that the voltage value satisfies the voltage threshold.

4. The system of claim 3, wherein the failsafe circuit is configured to generate the voltage value by generating the voltage value based on a root-mean-square voltage of the electronic signal of the sensor.

5. The system of claim 3, wherein the failsafe circuit is configured to:
- monitor additional data output by the sensor while the failsafe circuit receives an indication that the sensor is generating sensor data; and
- based on a voltage of the additional data output by the sensor while the failsafe circuit receives an indication that the sensor is generating sensor data, generate the voltage threshold.

6. The system of claim 1, wherein the monitor control unit is configured to provide, for output, data indicating that the sensor is generating the sensor data by providing, for output to the sensor, an instruction to activate a notification light of the sensor.

7. The system of claim 1, wherein the monitor control unit is configured to provide, for output, data indicating that the sensor is generating the sensor data by providing, for output to a resident of the property, a notification that the sensor is generating the sensor data.

8. The system of claim 1, wherein the failsafe circuit is configured to:
- based on monitoring an electronic signal of the sensor:
  - identify a token packet that indicates the sensor and the monitor control unit are communicating; and
  - determine that the sensor is generating the sensor data by determining that the electronic signal of the sensor includes the token packet and additional data.

9. The system of claim 8, wherein:
- the sensor is a microphone; and
- the failsafe circuit is configured to determine that the sensor is generating the sensor data by determining that the electronic signal of the sensor includes the token packet and audio data.

10. The system of claim 1, wherein the failsafe circuit is configured to:
- determine a frequency of token packets transmitted between the sensor and the monitor control unit;
- monitor the electronic signal of the sensor at a frequency that is greater than the frequency of the token packets being transmitted between the sensor and the monitor control unit;
- based on monitoring the electronic signal of the sensor at a frequency that is greater than the frequency of the token packets being transmitted between the sensor and the monitor control unit, determine that the electronic signal of the sensor includes the token packets and additional data; and
- determine that the sensor is generating the sensor data by determining that the electronic signal of the sensor includes the token packets and additional data.

11. The system of claim 10, wherein:
- the sensor is a camera; and
- the failsafe circuit is configured to determine that the electronic signal of the sensor includes the token packets and additional data by determining that the electronic signal of the sensor includes the token packets and video data.

12. The system of claim 1, wherein:

the electronic signal of the sensor is an output signal of the sensor that includes a data packet; and the failsafe circuit is configured to determine that the sensor is generating the sensor data based on determining that the output signal of the sensor includes a data packet.

13. The system of claim 1, wherein:

the electronic signal of the sensor is a signal indicating whether a power supply of the sensor is enabled; and the failsafe circuit is configured to determine that the sensor is generating the sensor data based on determining that the electronic signal of the sensor indicates that the power supply of the sensor is enabled.

14. The system of claim 1, wherein:

the electronic signal of the sensor is a signal indicating whether a component of the sensor is receiving power; and the failsafe circuit is configured to determine that the sensor is generating the sensor data based on determining that the electronic signal of the sensor indicates that the component of the sensor is receiving power.

15. The system of claim 14, wherein the component of the sensor is an image sensor.

16. The system of claim 1, wherein:

the electronic signal of the sensor is a signal indicating whether the sensor is enabled and generating data; and the failsafe circuit is configured to determine that the sensor is generating the sensor data based on determining that the electronic signal of the sensor indicates that the sensor is enabled and generating data.

17. The system of claim 1, wherein:

the electronic signal of the sensor is a signal indicating that a component of the sensor is enabled; and the failsafe circuit is configured to determine that the sensor is generating the sensor data based on monitoring the electronic signal of the sensor indicating that the component of the sensor is enabled.

18. The system of claim 1, wherein:

the sensor is further configured to transmit the sensor data;

the failsafe circuit is further configured to:

receive, from the monitor control unit, the data indicating that the sensor is generating the sensor data; and based on receiving, from the monitor control unit, the data indicating that the sensor is generating the sensor data, prevent the sensor from transmitting the sensor data.

19. A computer-implemented method, comprising:

monitoring, by a monitoring system that is configured to monitor a property, an electronic signal of a sensor of the monitoring system;

based on monitoring an electronic signal of the sensor, determining, by the monitoring system, that the sensor is generating sensor data;

determining, by the monitoring system, that the monitoring system did not generate a request for the sensor to generate the sensor data or that the monitoring system is not aware that the sensor is generating sensor data; and based on determining that the monitoring system did not generate a request for the sensor to generate the sensor data or that the monitoring system is not aware that the sensor is generating sensor data, provide, for output, data indicating that the sensor is generating the sensor data.

* * * * *